US010633847B2

(12) United States Patent
Wood et al.

(10) Patent No.: US 10,633,847 B2
(45) **Date of Patent: *Apr. 28, 2020**

(54) SELF-CONTAINED TOILET BOWL DISPENSER AND LIGHT

(71) Applicant: HOMEMATION LLC, Layton, UT (US)

(72) Inventors: Taylor Brett Wood, Provo, UT (US); Daken Marcus Tanner, Provo, UT (US); Jeremy Todd Stevenson, Orem, UT (US); Jacob Lynn Larsen, Kaysville, UT (US)

(73) Assignee: Homemation LLC, Layton, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/891,195

(22) Filed: Feb. 7, 2018

(65) Prior Publication Data

US 2018/0223516 A1 Aug. 9, 2018

Related U.S. Application Data

(63) Continuation-in-part of application No. 15/596,388, filed on May 16, 2017, now Pat. No. 10,370,837.
(Continued)

(51) Int. Cl.
*E03D 9/00* (2006.01)
*F21S 9/02* (2006.01)
(Continued)

(52) U.S. Cl.
CPC ..... *E03D 9/005* (2013.01); *E03D 9/00* (2013.01); *E03D 9/002* (2013.01); *F21S 9/02* (2013.01);
(Continued)

(58) Field of Classification Search
CPC . E03D 9/005; E03D 9/002; E03D 9/00; F21S 9/02; F21V 5/04; F21V 23/04; F21V 23/0464; F21V 23/0471; F21V 33/004
(Continued)

(56) References Cited

U.S. PATENT DOCUMENTS 4,327,451 A 5/1982 Baus
4,630,322 A 12/1986 Kuo
(Continued)

FOREIGN PATENT DOCUMENTS

CN 2307844 Y 2/1999
CN 2713029 Y 7/2005
(Continued)

OTHER PUBLICATIONS

International Search Report and Written Opinion dated Jul. 23, 2018 from International Patent Application No. PCT/US2018/017289 filed Feb. 7, 2018.
(Continued)

*Primary Examiner* — Tuan N Nguyen
(74) *Attorney, Agent, or Firm* — Workman Nydegger

(57) ABSTRACT

A toilet dispenser and light is disclosed. Upon detection and activation from sensors, a light may be used to illuminate a toilet bowl, and a treatment substance may be dispensed into the toilet bowl. The dispenser correspondingly configures to operate with the rim of a toilet bowl. Portions of the dispenser may be replaceable, such as a power source and a propellant container used to house a treatment substance. A system of multiple dispensers operable, respectively, to treat multiple toilets is also provided.

20 Claims, 30 Drawing Sheets

Related U.S. Application Data

(60) Provisional application No. 62/456,194, filed on Feb. 8, 2017.

(51) Int. Cl.

| | |
|---|---|
| ***F21V 5/04*** | (2006.01) |
| ***F21V 23/04*** | (2006.01) |
| ***F21V 33/00*** | (2006.01) |
| *A47K 17/00* | (2006.01) |

(52) U.S. Cl.
CPC ..... *F21V 5/04* (2013.01); *F21V 23/04* (2013.01); *F21V 23/0464* (2013.01); *F21V 23/0471* (2013.01); *F21V 33/004* (2013.01); *A47K 17/00* (2013.01)

(58) Field of Classification Search
USPC ..... 4/423
See application file for complete search history.

(56) References Cited

U.S. PATENT DOCUMENTS

| | | | |
|---|---|---|---|
| 5,031,252 | A | 7/1991 | Oyama |
| 5,136,476 | A | 8/1992 | Horn |
| 5,377,363 | A | 1/1995 | Shieh |
| 6,098,211 | A | 8/2000 | Ehrensperger et al. |
| 6,457,435 | B1 | 10/2002 | Bridges |
| 7,603,726 | B2 | 10/2009 | Sawalski et al. |
| 8,261,377 | B2 | 9/2012 | Oh |
| 8,359,676 | B2 | 1/2013 | Richard et al. |
| 8,603,257 | B2 | 12/2013 | Burt et al. |
| 8,966,676 | B2 | 3/2015 | Hamakita et al. |
| 9,375,745 | B2 | 6/2016 | Finch |
| 9,702,133 | B2 | 7/2017 | Hornsby et al. |
| 9,757,486 | B2 | 9/2017 | Dobrinsky et al. |
| 2004/0199985 | A1 | 10/2004 | Wilson et al. |
| 2009/0249533 | A1 | 10/2009 | Sawalski et al. |
| 2010/0031982 | A1 | 2/2010 | Hornsby et al. |
| 2010/0205728 | A1 | 8/2010 | Muhlhausen et al. |
| 2010/0205731 | A1 | 8/2010 | Muhlhausen et al. |
| 2010/0243776 | A1 | 9/2010 | Forster |
| 2011/0088153 | A1 | 4/2011 | Richard et al. |
| 2012/0266920 | A1 | 10/2012 | Burt et al. |
| 2013/0025038 | A1 | 1/2013 | Frey |
| 2014/0304903 | A1 | 10/2014 | Cogswell |
| 2017/0251893 | A1 | 9/2017 | Wink et al. |

FOREIGN PATENT DOCUMENTS

| | | | |
|---|---|---|---|
| CN | 2761716 | Y | 3/2006 |
| CN | 2761717 | Y | 3/2006 |
| CN | 2765955 | Y | 3/2006 |
| CN | 2765956 | Y | 3/2006 |
| CN | 2765957 | Y | 3/2006 |
| CN | 2775158 | Y | 4/2006 |
| CN | 2782797 | Y | 5/2006 |
| CN | 2784483 | Y | 5/2006 |
| CN | 2786212 | Y | 6/2006 |
| CN | 2796628 | Y | 7/2006 |
| CN | 2910086 | Y | 6/2007 |
| CN | 201087471 | Y | 7/2008 |
| CN | 1755055 | B | 10/2010 |
| CN | 202017245 | U | 10/2011 |
| CN | 101736794 | B | 11/2011 |
| CN | 202139666 | U | 2/2012 |
| CN | 204155099 | U | 2/2015 |
| CN | 104644045 | A | 5/2015 |
| CN | 204995346 | U | 1/2016 |
| CN | 105649159 | A | 6/2016 |
| CN | 106368279 | A | 2/2017 |
| CN | 206467740 | U | 2/2017 |
| CN | 106522329 | A | 3/2017 |
| CN | 206294707 | U | 7/2017 |
| CN | 206477413 | U | 9/2017 |
| CN | 206554209 | U | 10/2017 |
| CN | 206571202 | U | 10/2017 |
| EP | 2657415 | A1 | 10/2013 |
| FR | 2907813 | A1 | 5/2008 |
| JP | 2000096676 | A | 4/2000 |
| JP | 2001227026 | A | 8/2001 |
| JP | 2005344300 | A | 12/2005 |
| JP | 2007209642 | A | 8/2007 |
| JP | 2008174957 | A | 7/2008 |
| JP | 2012082615 | A | 4/2012 |
| JP | 2012149512 | A | 8/2012 |
| JP | 2012202102 | A | 10/2012 |
| JP | 2013079578 | A | 5/2013 |
| JP | 2013155595 | A | 8/2013 |
| JP | 2014163162 | A | 9/2014 |
| JP | 2016037702 | A | 3/2016 |
| JP | 2016044400 | A | 4/2016 |
| JP | 2016094712 | A | 5/2016 |
| JP | 2017160653 | A | 9/2017 |
| KR | 101729571 | B1 | 5/2017 |
| TW | 201008538 | A | 3/2010 |
| TW | M451469 | U | 4/2013 |
| WO | 2016079914 | A1 | 5/2016 |
| WO | 2016157859 | A1 | 10/2016 |
| WO | 2016208175 | A1 | 12/2016 |
| WO | 2017169221 | A1 | 10/2017 |
| WO | 2017169222 | A1 | 10/2017 |
| WO | 2017169223 | A1 | 10/2017 |
| WO | 2017169224 | A1 | 10/2017 |
| WO | 2017169227 | A1 | 10/2017 |

OTHER PUBLICATIONS

Office Action dated Jun. 15, 2018 from U.S. Appl. No. 15/928,018, filed Mar. 21, 2018.
Office Action dated Sep. 12, 2018 from U.S. Appl. No. 15/890,938, filed Feb. 7, 2018.
Office Action dated Sep. 13, 2018 from U.S. Appl. No. 15/928,018, filed Mar. 21, 2018.
Office Action dated Jul. 13, 2018 from U.S. Appl. No. 15/596,388, filed May 16, 2017.
Office Action dated Dec. 19, 2018 from U.S. Appl. No. 15/596,388, filed May 16, 2017.
Notice of Allowance dated Mar. 29, 2019 from U.S. Appl. No. 15/596,388, filed May 16, 2017.
Restriction Requirement dated Sep. 12, 2018 from U.S. Appl. No. 15/890,651, filed Feb. 7, 2018.
Office Action dated Oct. 29, 2018 from U.S. Appl. No. 15/890,651, filed Feb. 7, 2018.
Office Action dated Jun. 13, 2019 from U.S. Appl. No. 15/890,651, filed Feb. 7, 2018.
Office Action dated Nov. 27, 2018 from U.S. Appl. No. 15/928,018, filed Mar. 21, 2018.
Office Action dated Apr. 1, 2019 from U.S. Appl. No. 15/928,018, filed Mar. 21, 2018.
Notice of Allowance dated Aug. 21, 2019 from U.S. Appl. No. 15/928,018, filed Mar. 21, 2018.
Notice of Allowance dated Oct. 21, 2019 from U.S. Appl. No. 15/928,018, filed Mar. 21, 2018.
Office Action dated Nov. 29, 2018 from U.S. Appl. No. 15/890,938, filed Feb. 7, 2018.
Notice of Allowance dated Apr. 3, 2019 from U.S. Appl. No. 15/890,938, filed Feb. 7, 2018.
Issue Notification dated Jul. 24, 2019 from U.S. Appl. No. 15/890,938, filed Feb. 7, 2018.

SELF-CONTAINED TOILET BOWL DISPENSER AND LIGHT

CROSS REFERENCE TO RELATED APPLICATION(S)

This application is a Continuation-in-Part of U.S. patent application Ser. No. 15/596,388, filed May 16, 2017, which claims the benefit of U.S. Provisional Patent Application No. 62/456,194, filed Feb. 8, 2017, the disclosures of which are hereby incorporated entirely herein by reference.

BACKGROUND OF THE INVENTION

The Field of the Invention

The invention relates generally to toiletry maintenance and hygiene, wherein the inner surface of a toilet bowl is sprayed with a treatment substance to clean and/or freshen a toilet.

The Relevant Technology

Using the commode can be a dreaded process. Often public restrooms are filled with unpleasant odors, smells, and garbage. Some prefer to forgo public restrooms entirely to avoid unsightly smells. The inside of a toilet bowl can become pasted with refuse where smells and bacteria can linger. Public restrooms often use urinal blocks to provide odor relief, but the utility of these blocks is compromised when applied to a general, sitting toilet.

Private toilet use can likewise be an uncomfortable experience, where a user does not want smells permeating throughout a home, or where a user does not want smells to linger for the next occupant. Some manual hand sprays are used to mask unpleasant odors in the toilet bowl, but these sprays only work if the user chooses to spray the fragrance. Additionally, these sprays require users to carry them around in case there is a time of need.

Various dispensers have been conceived. Some dispensers discharge fragrance from a wall in hopes that the fragrance diffuses throughout the room. Other dispensers use the mechanical pressure of flushing the toilet handle to actuate a discharge of the dispenser. Some dispensers use the flow of water through or around the dispenser to discharge material into a toilet bowl.

As discussed, different dispensing models have been produced throughout the years, however, these attempts have failed to provide sufficient value to produce a ubiquitous, commercially-successful toilet dispenser.

BRIEF SUMMARY OF THE INVENTION

It is a main object of the present invention to provide a toilet dispenser and light that can be fitted around a toilet rim, thus providing the user with automatic lighting and dispensing of a treatment substance into a toilet bowl. In at least one disclosed embodiment the invention comprises a body, a connecting portion extending from the body, an arm extending from the connecting portion, a nozzle connected to the arm, at least one control circuit within the body, at least three sensing units communicatively coupled with the at least one control circuit, a power source within the body, a replaceable propellant container within the body, at least a first and second pouch within the propellant container, at least one liquid treatment substance within the first and second pouch, a conduit connecting the propellant container and nozzle, and a light located on the arm, wherein the light is communicatively coupled with the at least one control circuit and wherein the light emits visible light into a toilet bowl.

In at least one disclosed embodiment the invention comprises a method of measuring that ambient light intensity near a toilet does not exceed a predetermined intensity threshold, detecting that a user is in an area adjacent to the toilet, activating a light and secondary sensor within a toilet bowl for a predetermined period of time, detecting a user in close proximity to the toilet bowl, and discharging a treatment substance into a toilet bowl.

Another disclosed aspect provides a toilet bowl water surface treatment applicator, comprising: a body; a head portion operable with the body; a connecting portion connecting the body to the head portion, the connecting portion shaped to attach and align the applicator to a toilet bowl; an occupancy sensor located in the head portion, the occupancy sensor, when mounted to a toilet bowl, the occupancy sensor oriented inward of the toilet bowl in a manner that it may detect the presence of a user sitting on the toilet; and an oil dispensing tip located in the head portion, the oil dispensing tip, when mounted to a toilet bowl, oriented to dispense oil on a water surface of water in the toilet bowl.

A further disclosed aspect provides an applicator device for automatically dispensing a water surface sealant onto a surface of a toilet bowl water, the device comprising: a body, the body having a cartridge cavity; a cartridge removably located within the cartridge cavity, the cartridge having a reservoir containing a water surface sealant including a non-polar solvent; a connector portion for coupling the body to a toilet; a controller located in the body; a power source in electrical communication with the controller; a bowl sensor attached to the body and in communication with the controller; a sealant dispenser attached to the body and in electrical communication with the controller and in fluid communication with the reservoir; and an orifice, when mounted to a toilet bowl, configured and oriented to dispense the water surface sealant onto the surface of the toilet bowl water.

Yet another disclosed aspect provides a toilet bowl water surface treatment applicator, comprising: a body; a toilet connector for mounting the body to a toilet; a controller associated with the applicator; an electrical power source in electrical communication with the controller; a liquid surface sealant in fluid communication with the applicator; a means for detecting a user sitting on the toilet in communication with the controller; and a means for dispensing the surface sealant onto the surface of water of the toilet bowl.

Still a further disclosed aspect provides a replaceable cartridge of an oil based toilet water sealant, comprising; a frame having a distal end, a proximal end, and a lateral cavity located substantially between the distal end and the proximal end; a reservoir removably coupled to the frame; an oil based toilet bowl water sealant located within the reservoir; a valve located in fluid communication with the reservoir and configured to selectively release a volume of the oil based toilet bowl water sealant from proximal end of the frame; a power source located within the lateral cavity, the lateral cavity having a distal end and a proximal end corresponding to the distal end and the proximal end of the frame; and a power contact located at the proximal end of the lateral cavity oriented to provide power to an external dispensing mechanism.

Yet still another disclosed aspect provides a replaceable cartridge of an oil based toilet water sealant, the cartridge adapted to mate with a water surface sealant applicator having a connector for mounting the applicator to a toilet bowl, the applicator further having a controller, an actuator, a sensor, and a cartridge receptacle, the cartridge comprising: a frame having a distal end and a proximal end; a reservoir located within the frame; a non-polar solvent based toilet bowl water sealant located within the reservoir; a valve for selectively releasing the non-polar solvent based toilet bowl water sealant, wherein the valve, upon installation into the applicator, is in mechanical communication with the actuator; a power source located within the frame, the power source, upon installation into the applicator, is in electrical communication with the controller and provides power to the sensor; and a power contact electrically connected to the power source and outwardly oriented on the frame.

An additional disclosed aspect provides a method for automatically treating the surface of toilet bowl water with an oil based liquid barrier, the method comprising: providing a dispensing apparatus removably mounted to a toilet bowl and having an inwardly oriented occupancy sensor, an oil dispenser, and a control circuit, the control circuit configured to receive an input from the occupancy sensor and to provide a command to the oil dispenser; sensing, by the occupancy sensor, the presence of a user sitting on the toilet; communicating the occupancy sensor input to the control circuit; sending a signal by the control circuit to the oil dispenser to discharge a volume of the oil based liquid barrier; and treating the surface of the bowl water with the oil based liquid layer.

Moreover, another disclosed aspect provides a method for automatically treating the surface of toilet bowl water with a non-polar solvent barrier, the method comprising: providing a dispensing apparatus having a control circuit in electrical communication with a sensor and an actuator; loading a cartridge into the dispensing apparatus, the cartridge having a non-polar solvent surface water sealant, a valve, and a power source; powering the control circuit by the power source; detecting, by the sensor, the presence of a user sitting on the toilet; signaling, by the control circuit, the actuator to open the valve once a user's presence is detected; and dispensing a layer of non-polar solvent onto the surface of the bowl water of the toilet.

In addition, another disclosed aspect provides a method for automatically creating an oil barrier on bowl water of a toilet prior to a dispensing of human waste into the toilet, the method comprising: passively detecting a user proximate to the toilet; upon detecting a user proximate to the toilet, activating an active sensor to determine if a user is sitting on the toilet; triggering, upon the user sitting on the toilet, an actuator to release an oil barrier substantially onto the bowl water of the toilet; actively sensing if the user is still sitting on the toilet; and upon detecting that the user is no longer sitting on the toilet, resetting a spray operation and passively scanning to detect a user proximate to the toilet.

These and other objects, aspects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Various aspects of the novel systems, apparatuses, and methods are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the novel systems, apparatuses, and methods disclosed herein, whether implemented independently of, or combined with, any other aspect of the invention. For example, an apparatus may be implemented or a method may be practiced using any number of the aspects set forth herein. In addition, the scope of the invention is intended to cover such an apparatus or method which is practiced using other structure, functionality, or structure and functionality in addition to or other than the various aspects of the invention set forth herein. It should be understood that any aspect disclosed herein may be embodied by one or more elements of a claim.

Although particular aspects are described herein, many variations and permutations of these aspects fall within the scope of the disclosure. Although some benefits and advantages of the preferred aspects are mentioned, the scope of the disclosure is not intended to be limited to particular benefits, uses, or objectives. Rather, aspects of the disclosure are intended to be broadly applicable to different dispensers, some of which are illustrated by way of example in the figures and in the following description of the preferred aspects. The detailed description and drawings are merely illustrative of the disclosure rather than limiting, the scope of the disclosure being defined by the appended claims and equivalents thereof.

The attached drawings illustrate examples. Elements indicated by reference numbers in the attached drawings correspond to elements indicated by like reference numbers in the following description.

Figure 1:
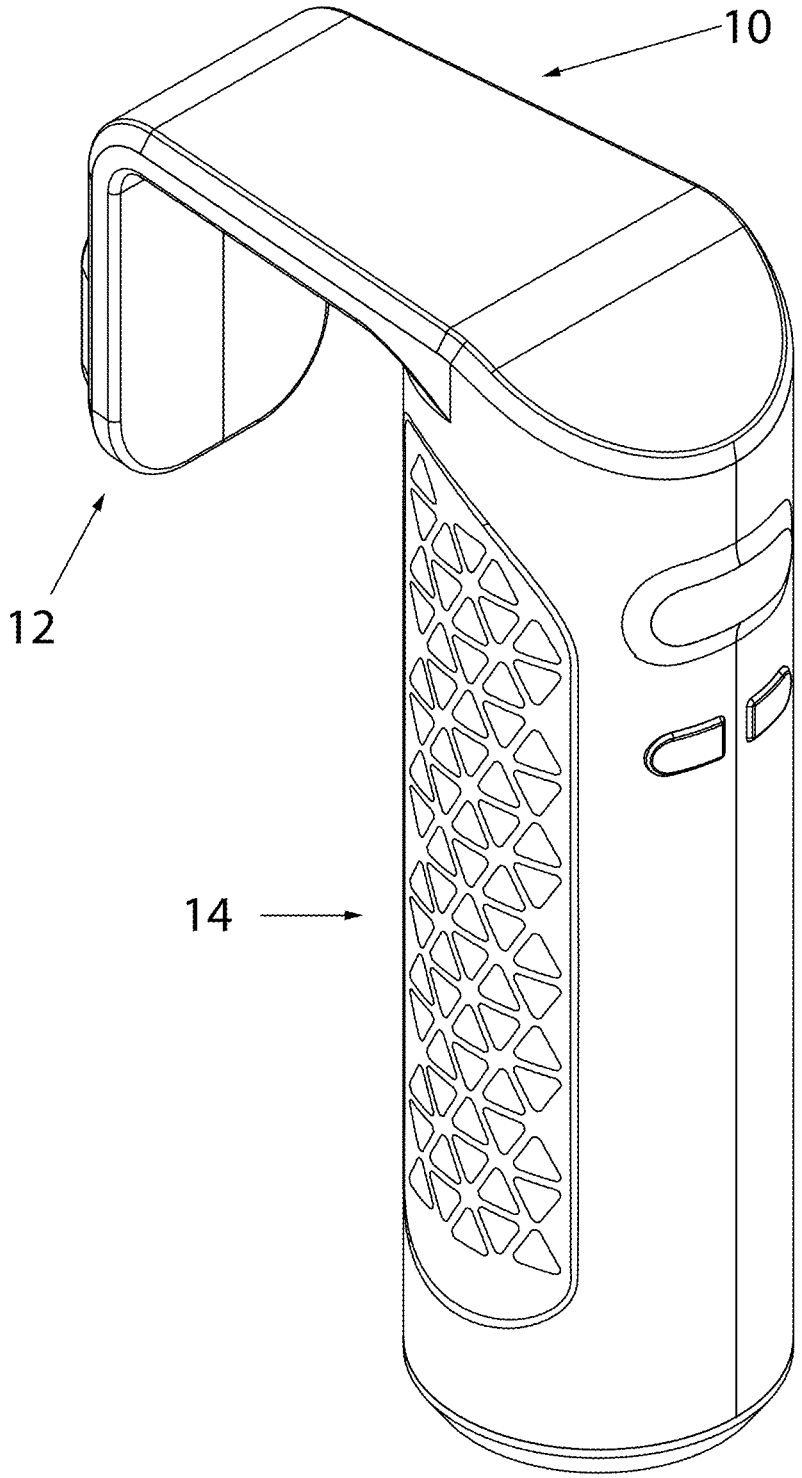
FIG. 1 illustrates an elevational view of the dispenser.

Referring to FIG. 1, a toilet bowl water surface treatment applicator is shown comprising a connecting portion 10 that extends from a body 14. The connecting portion 10 may be shaped to help attach and align the applicator to a toilet bowl. An arm 12, which comprises a head portion, extends from connecting portion 10. The connecting portion 10, body 14, and head portion arm 12 are shaped in such a manner as to coincide with the geometry of a toilet, and may facilitate removable coupling of the toilet bowl water surface treatment applicator to a toilet, thereby permitting automatic dispensing of a water surface sealant onto a surface of the toilet bowl water.

Figure 2:
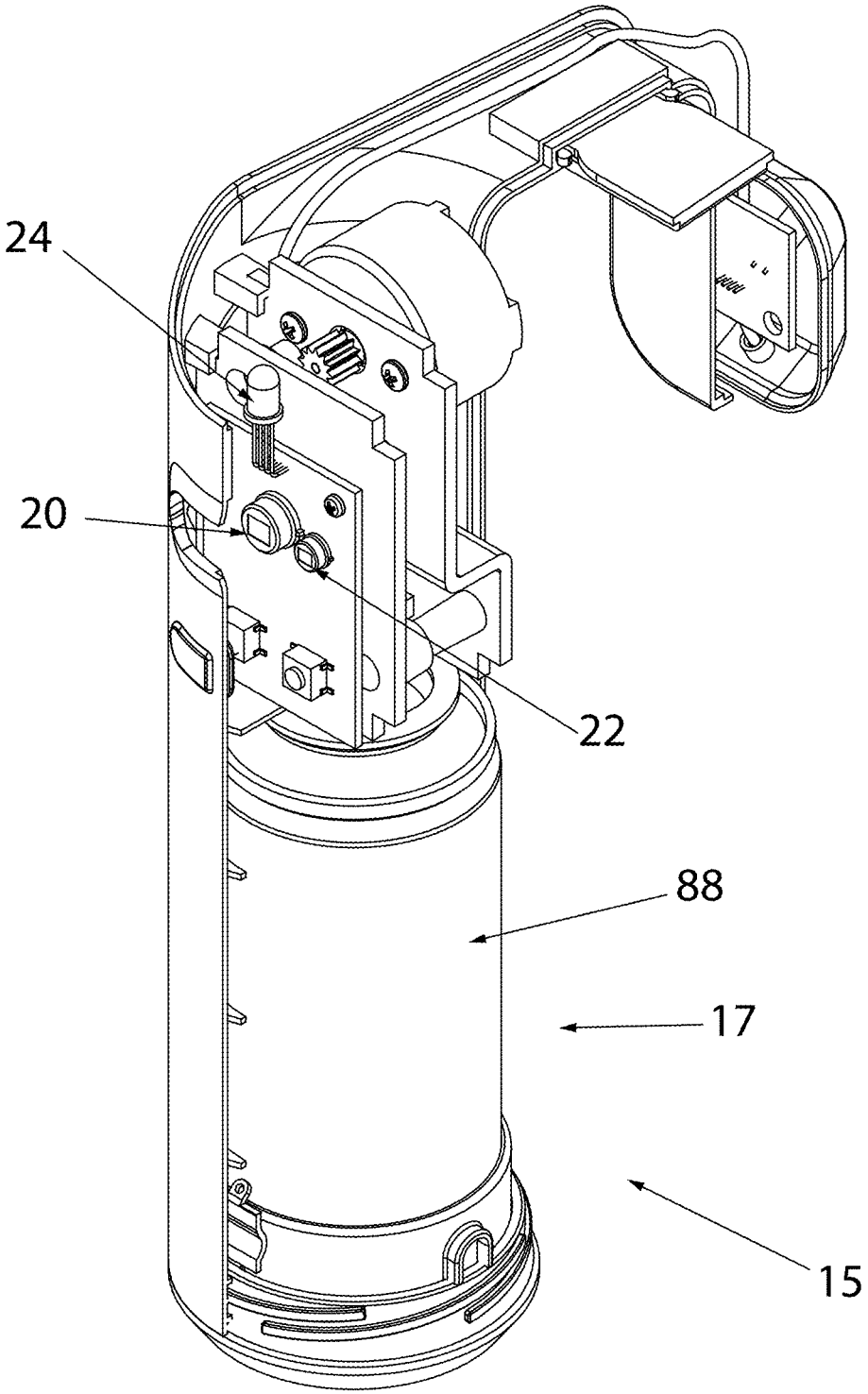
FIG. 2 illustrates a cutaway view of the dispenser featuring the sensors and indicator light on the body of the dispenser.

Referring to FIG. 2, indicator 24 is an indicator light positioned at the top of body 14. When indicator 24 is in use, it shines through a transparent covering on the top of body 14. In at least one embodiment, indicator 24 is a red, green, and yellow light emitting diode (LED), but various other light sources may be used. Indicator 24 signifies, through various blinking patterns and colors, that the propellant container 88 comprising a reservoir of water surface sealant needs to be replaced, that the user has turned off the dispensing function of the dispenser for a period of time, that the user has turned on the dispensing function of the dispenser, or that the user has manually initiated an on-demand spray. The reservoir, which may be housed within propellant container 88, may be part of a cartridge 17 that may be removably mounted within a cartridge cavity 17 of body 14.

Ambient sensor 22 detects ambient light intensity surrounding the body of the dispenser. Ambient sensor 22 could be any form of photodetector or photosensor. In at least one embodiment ambient sensor 22 is a photodiode, photo transistor, photoresistor, photodiode LED, or quantum dot photodetector. Ambient sensor 22 actuates a signal to at least one control circuit when the ambient light intensity surrounding the body of the dispenser does or does not exceed a predetermined threshold. Preferably the light intensity threshold corresponds to a dimly-lit room. In at least one embodiment the light intensity threshold is about 5 lux. In at least one embodiment the light intensity threshold is at least 5 lux. In at least one embodiment the light intensity threshold is about 10 lux. In at least one embodiment the light intensity threshold is anywhere from 5 to 100 lux. In at least one embodiment the light intensity threshold is anywhere from 100 to 1,000 lux.

Exterior sensor 20 detects occupancy of a user in the field of view on the exterior of body 14. Exterior sensor 22 may facilitate passive sensing to determine whether a user is proximate the body 14, as removably mounted on a toilet. In at least one embodiment it is a passive infrared sensor, however exterior sensor 20 could be any form of an occupancy sensor. Examples of these include an active infrared sensor, ultrasonic sensor, or the like. Exterior sensor 20 communicates with body PCB 84 or arm PCB 110, as depicted and described with regard to FIGS. 8 and 10 respectively, when occupancy of a user is detected.

Figure 3:
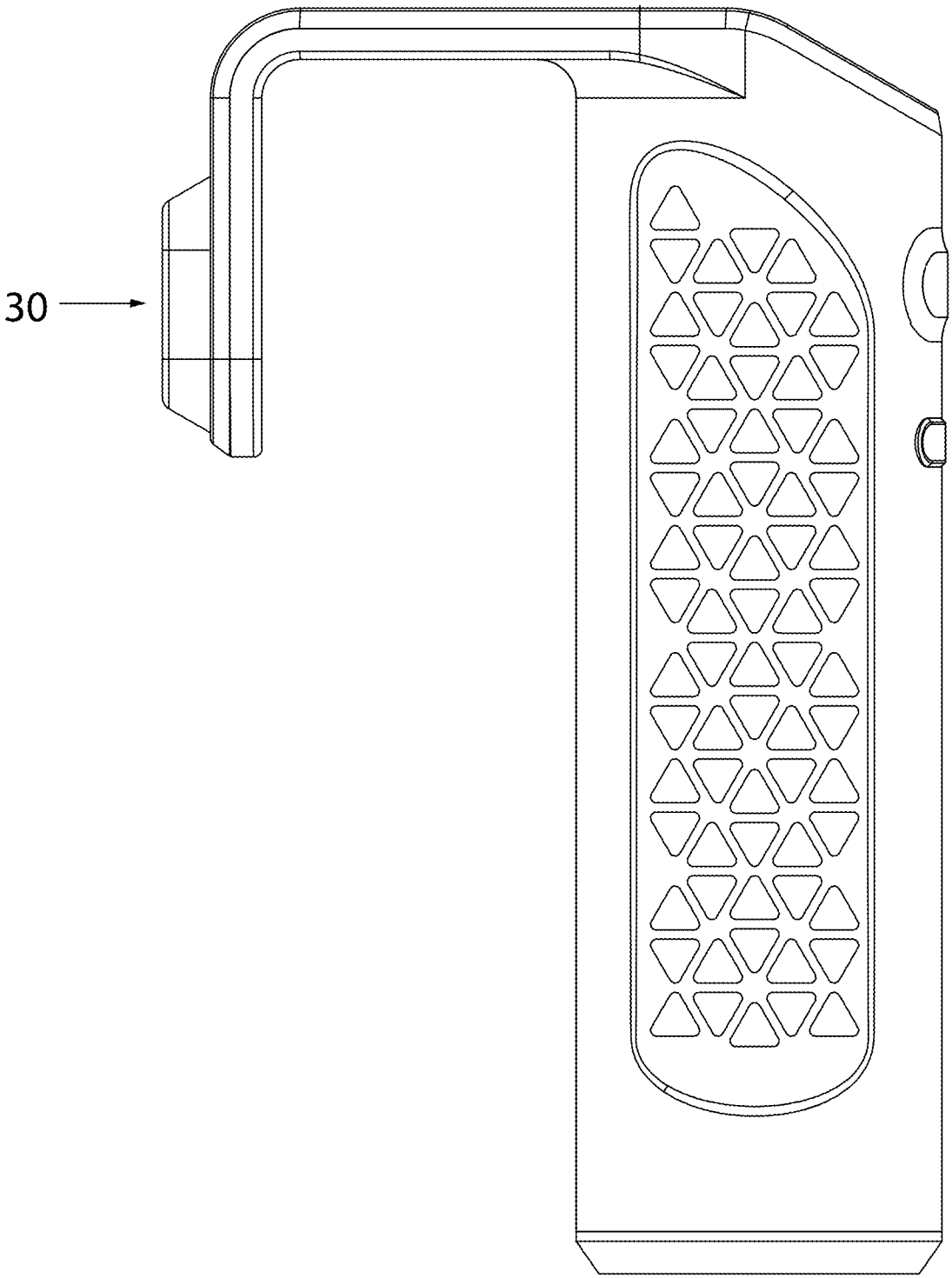
FIG. 3 illustrates a side view of the dispenser.

Referring to FIG. 3, protrusion 30 is located on the lower portion of arm 12. It houses several components that will be discussed hereafter.

Figure 4:
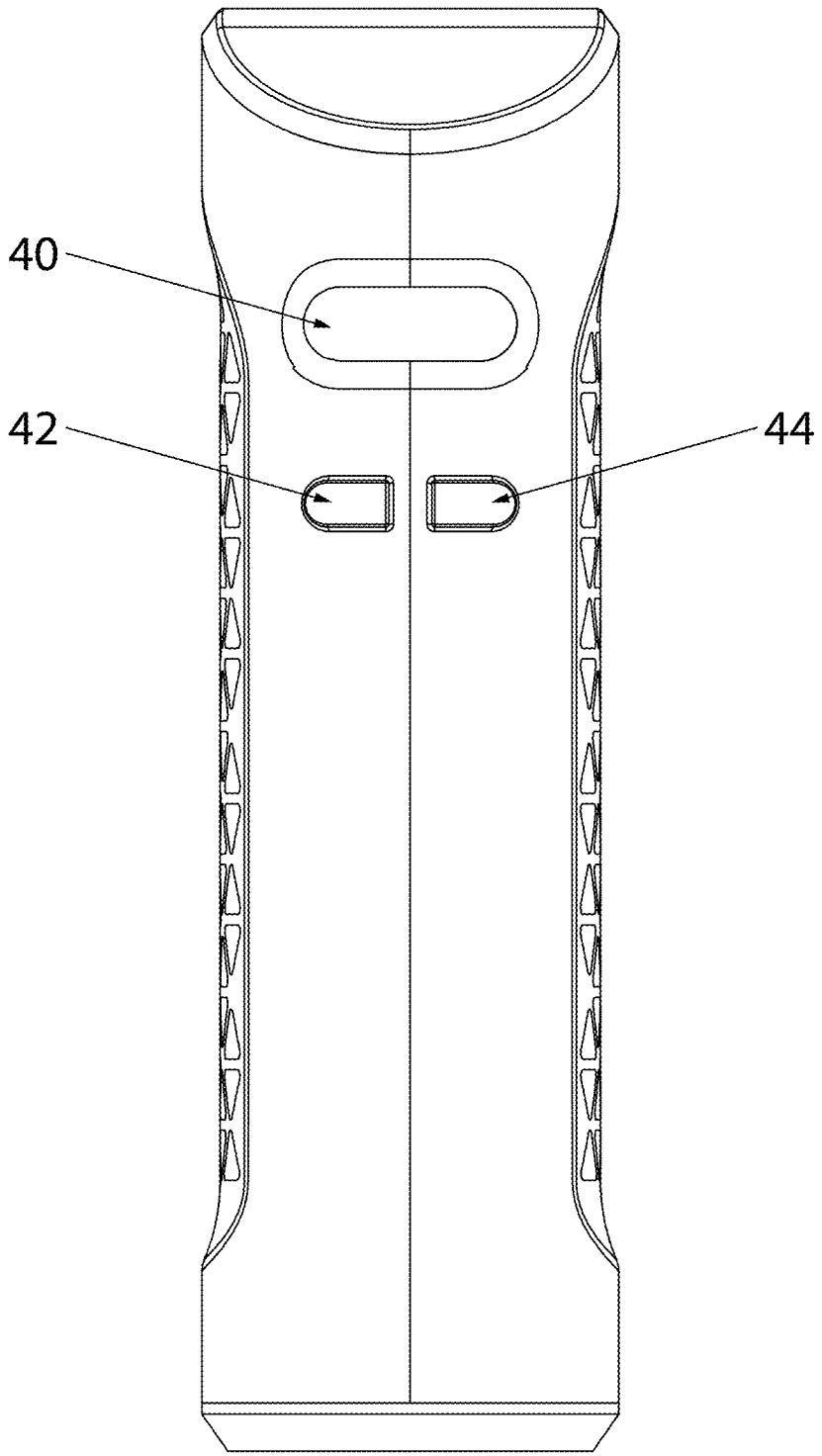
FIG. 4 illustrates a part of the body of the dispenser.

Referring to FIG. 4, cover 40 may be a transparent cover on the outside of exterior sensor 20 and ambient sensor 22. Electromagnetic waves pass through cover 40 before being transmitted from or falling on exterior sensor 20 or ambient light sensor 22. Cover 40 could be any transparent material that sufficiently conveys light. In at least one embodiment cover 40 is a translucent material.

Light toggle 44 is located on body 14 and enables a user to manually turn on light 112 for a predetermined period of time, change the color of light 112, turn off light 112 for an extended period of time, turn off light 112 for a shortened period of time, or the like.

Dispensing toggle 42 is located on body 14 and enables a user to immediately discharge a treatment substance into a toilet bowl 132, turn off the discharging function for an extended period of time, turn on the discharging function, turn off the discharging function for a shortened period of time, or the like. Both light toggle 44 and dispensing toggle 42 require a user to manually push the toggle to initiate a response.

Figure 5:
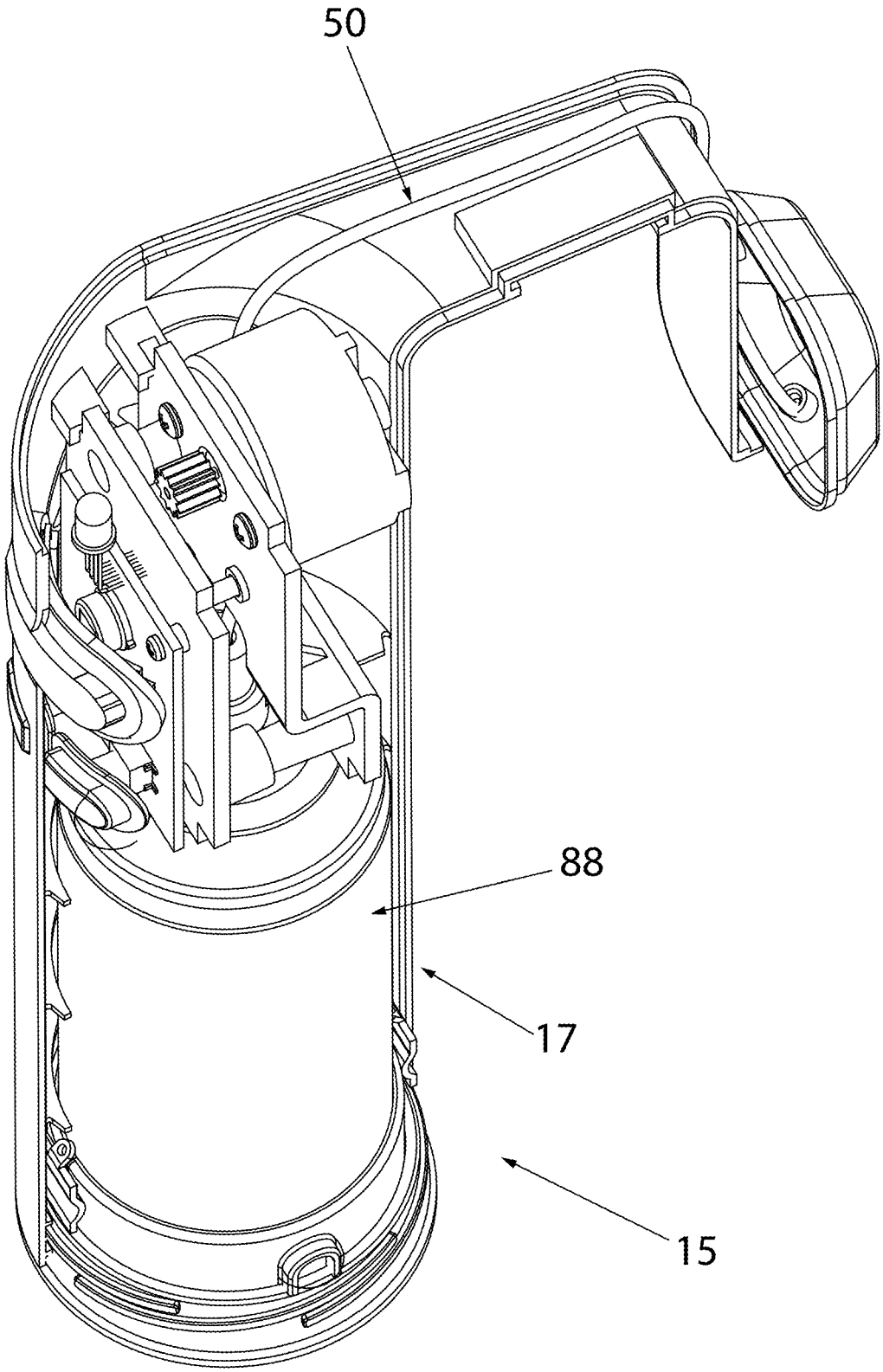
FIG. 5 illustrates a cutaway view of the dispenser featuring a conduit.

Referring to FIG. 5, conduit 50 runs from propellant container 88 to nozzle 100 and enables the passage of treatment substances, such as water surface sealant or fragrances, from the reservoir(s) that may be associated with propellant container 88 to a nozzle 100. Wiring for electrical power or signal transmission may also run along conduit 50.

Figure 6:
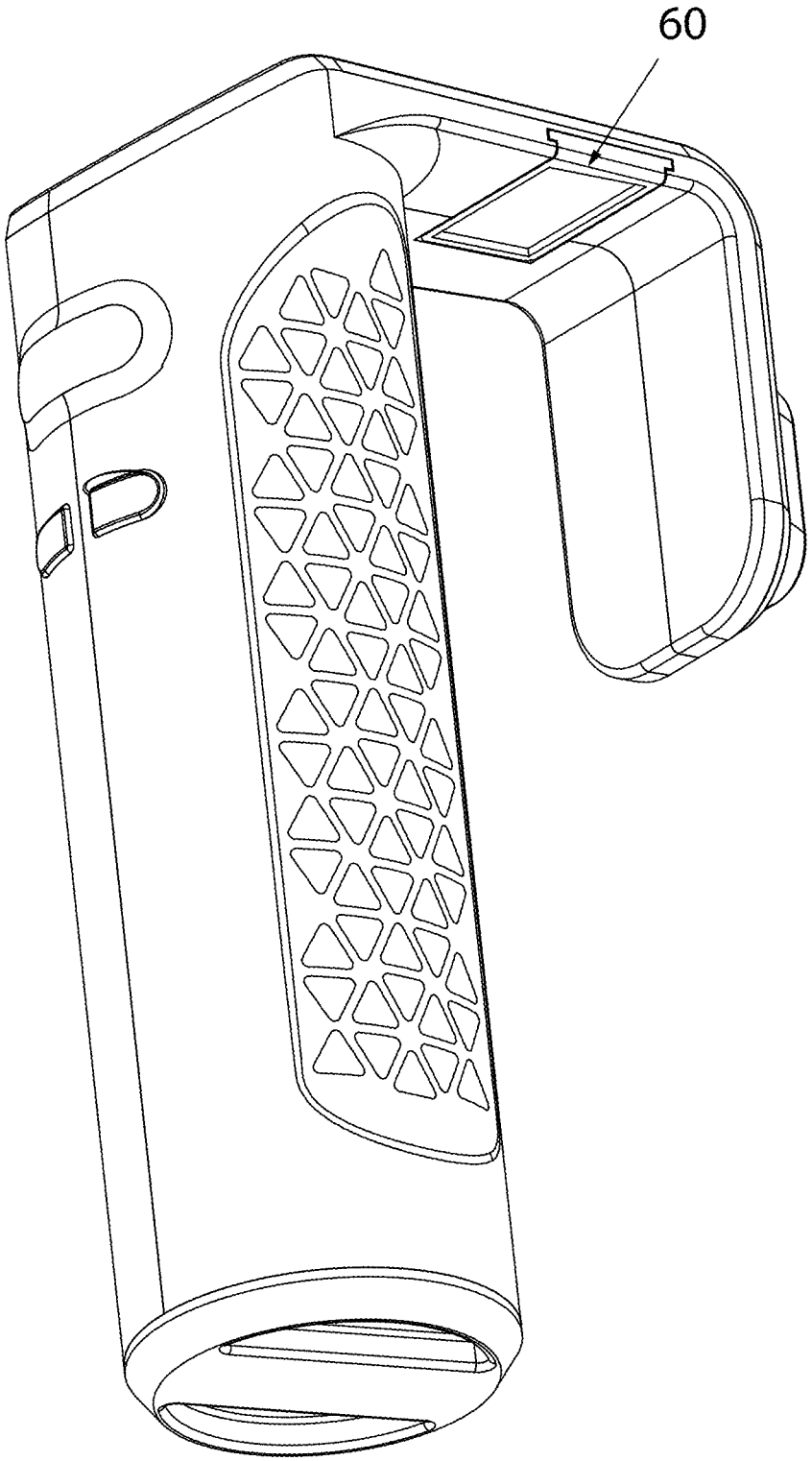
FIG. 6 illustrates an elevational view of the dispenser featuring a mounting clip inserted.

Referring to FIG. 6, mounting clip 60 is configured in size and shape to detachably connect to connecting portion 10. In at least one embodiment, mounting clip 60 attaches to a toilet bowl 132 through adhesives. In at least one embodiment mounting clip 60 attaches to a toilet bowl 132 through suction. In at least one embodiment, mounting clip 60 is replaceable. In at least one embodiment mounting clip 60 emits fragrances.

Figure 7:
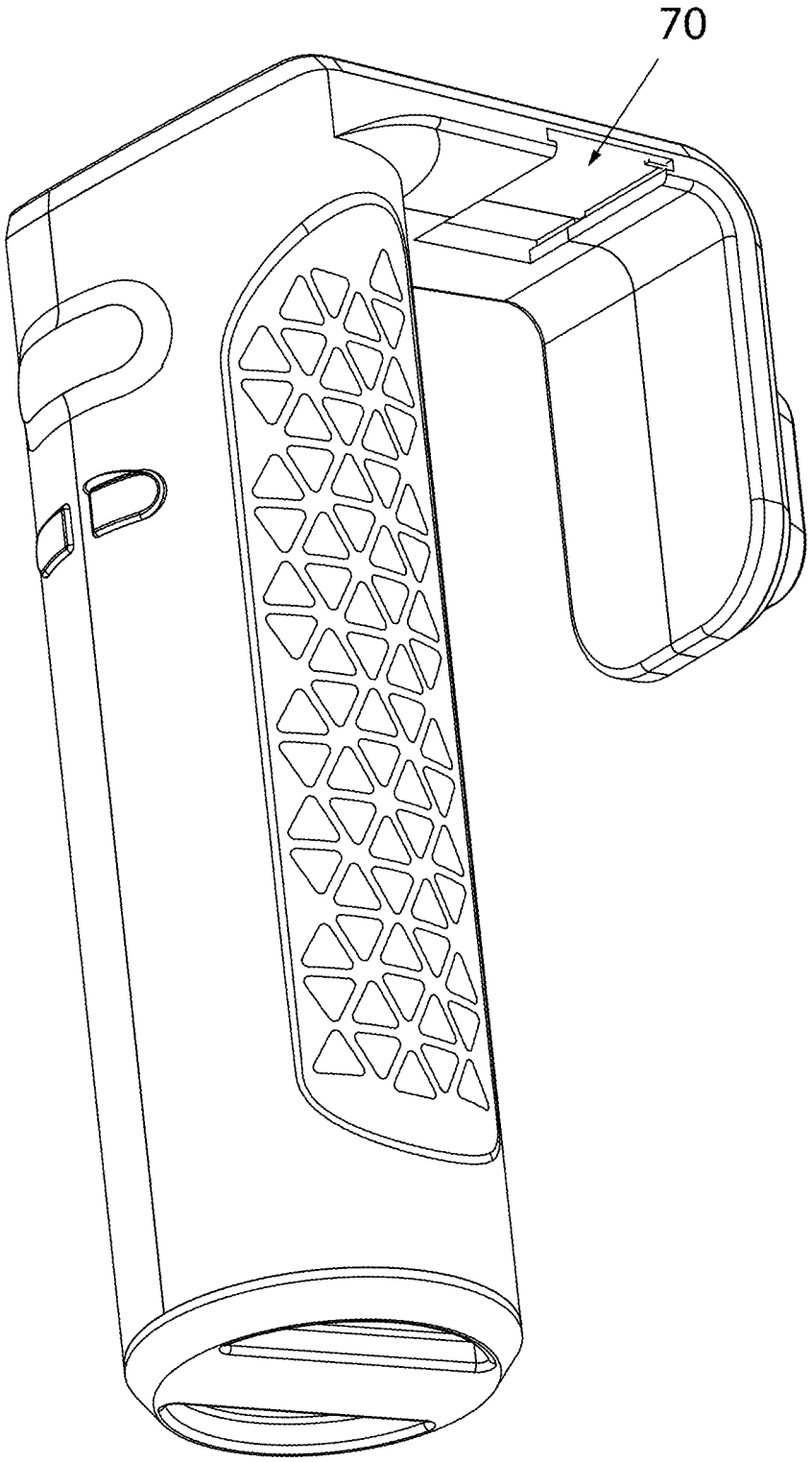
FIG. 7 illustrates an elevational view of the dispenser featuring a groove with the mounting clip removed.

Referring to FIG. 7, mounting clip groove 70 is located on connecting portion 10 and facilitates the attachment of mounting clip 60 to connecting portion 10. In at least one embodiment, mounting clip groove 70 contains a locking portion to secure mounting clip 60 to mounting clip groove 70. In at least one embodiment mounting clip groove 70 contains magnetic strips that correspond to magnetic portions on mounting clip 60, thus securing mounting clip 60 to mounting clip groove 70. In at least one embodiment, mounting clip groove 70 and mounting clip 60 correspondingly fit together in a complementary fashion such as through a sliding dovetail, dado, dovetail, tongue and groove, or the like.

Figure 8:
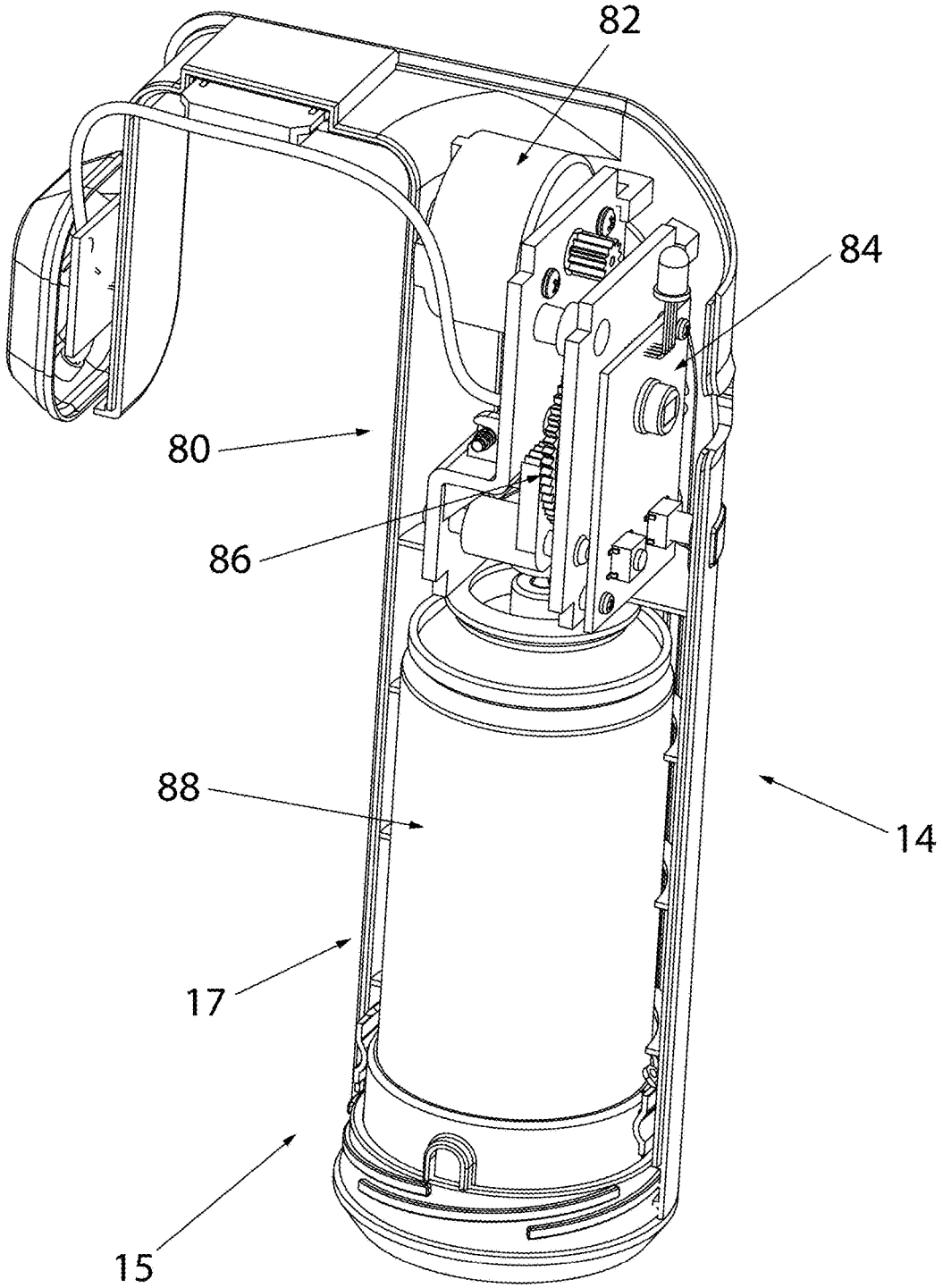
FIG. 8 illustrates a cutaway view of the dispenser featuring many of the internal mechanics.

Referring to FIG. 8, propellant container 88 is housed within body 14. Propellant container 88 may comprise one or more reservoirs holding treatment materials such as water surface sealant or fragrances and may be attached to conduit 50. Propellant container 88 may be any form of container that houses liquids and/or gasses. In at least one embodiment, propellant container 88 is an aerosol container. In at least one embodiment propellant container 88 is pressurized. In at least one embodiment propellant container houses a first pouch 120 and a second pouch 122, as depicted and described in further detail with regard to FIG. 12. In at least one embodiment propellant container 88 is replaceable. The propellant container 88 comprising a reservoir of treatment material may be a removable component element of a cartridge 15 that may be removably mounted within a cartridge cavity 17 of the body 14.

Body 14 may also house internal mechanics 80. The internal mechanics 80 may work in harmony to actuate a discharge of treatment material from a reservoir possibly associated with propellant container 88. Motor 82 is electrically connected to power source 90. Motor 82 drives internal gears 86 to actuate a discharge, or motor 82 may operate with or as a solenoid to open or close valves possibly configured or located for controlling the release and/or dispensing of treatment material. In at least one embodiment, body PCB 84 is a controller comprising a control circuit that, as further depicted and described in harmony with arm PCB 110 shown in FIG. 11, electrically communicates with ambient sensor 22, exterior sensor 20, motor 82, internal sensor 114 & 116, light 112, light toggle 42, dispensing toggle 44, indicator 24, or the like. The control circuit may operate as a discharge circuit programmed to actuate a discharge of a spray of oil onto a water surface of toilet bowl water upon detecting a user sitting on the toilet. In at least one embodiment, the detection of occupancy from exterior sensor 20 prompts body controller PCB 84 to activate internal sensor 114 & 116 for a shortened period of time. In at least one embodiment internal sensor 114 & 116 are always activated. In at least one embodiment, the detection of occupancy from exterior sensor 20 prompts body controller PCB 84 to activate light 112 for a shortened period of time. In at least one embodiment, the detection by ambient sensor 22 of light intensity exceeding a predetermined threshold prompts body controller PCB 84 to prevent the activation of light 112. In at least one embodiment, the detection of occupancy by internal sensor 114 & 116 prompts body controller PCB 84 to actuate a signal to discharge a treatment substance. In at least one embodiment, the detection of occupancy by exterior sensor 20 prompts body controller PCB 84 to actuate a signal to discharge a treatment substance. In at least one embodiment, the pressing of dispensing toggle 42 prompts body controller PCB 84 to immediately actuate a discharge. In at least one embodiment, the prolonged pressing of dispensing toggle 42 prompts body controller PCB 84 to prevent a discharge for a period of time. In at least one embodiment, the pressing of light toggle 44 prompts body controller PCB 84 to immediately activate light 112 for a period of time. In at least one embodiment, the prolonged pressing of light toggle 44 prompts body controller PCB 84 to prevent the activation of light 112 for a period of time. In at least one embodiment, the pressing of light toggle 44 prompts body controller PCB 84 to change the color of light 112. In at least one embodiment, the detection of an expelled, or a near-expelled, propellant container prompts body controller PCB 84 to activate indicator 24. In at least one embodiment, the detection of an expelled, or a near-expelled, propellant container prompts body controller PCB 84 to change the color of indicator 24. Activation of lights or dispensing functionality may be initiated by an additional controller remotely connected either wirelessly or by wired connection to controller PCB 84 and/or controller PCB 110.

Figure 9:
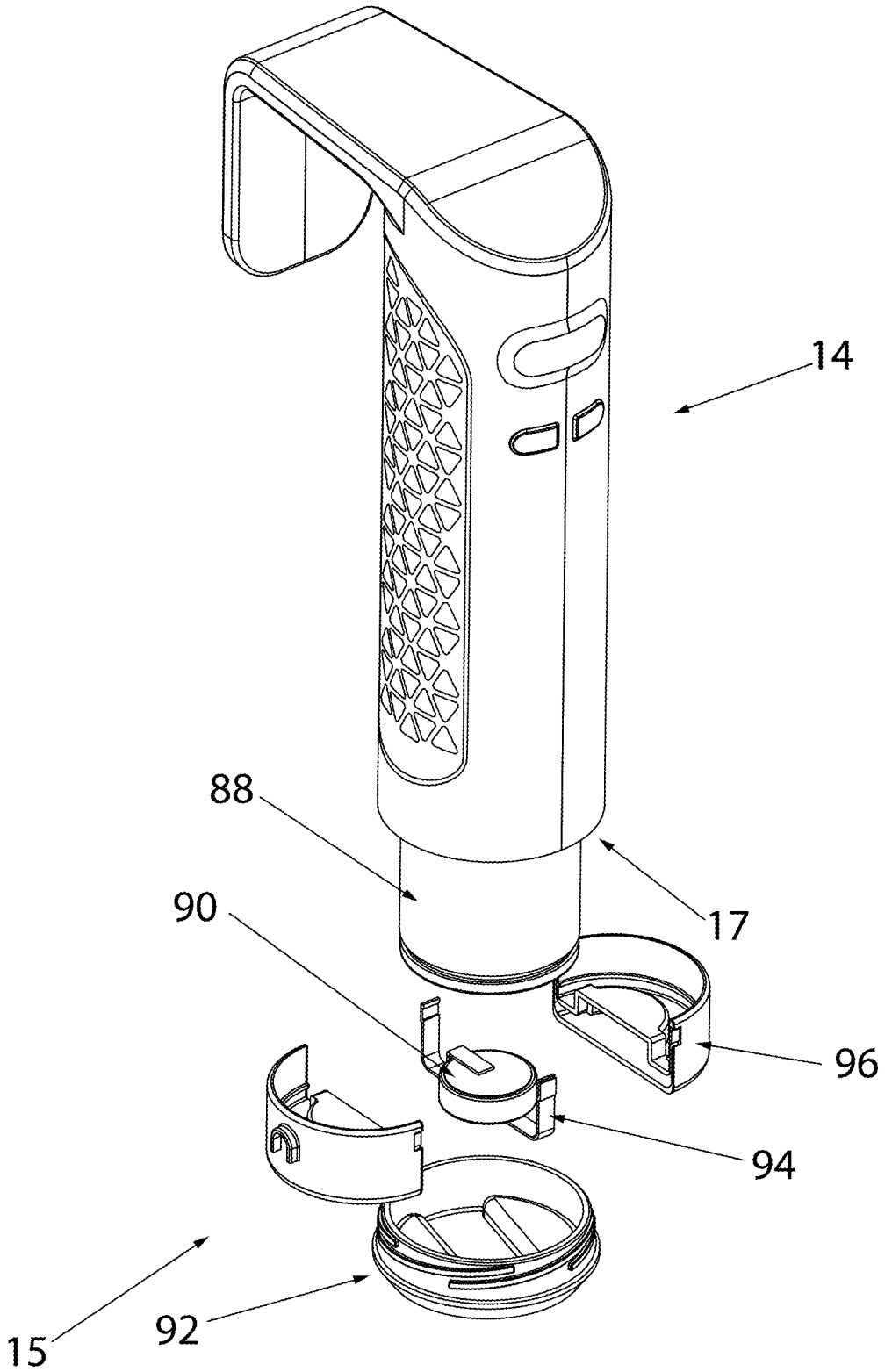
FIG. 9 illustrates an exploded view of removable components of the body of the dispenser.

Referring to FIG. 9, power source 90 provides power for the electronic components of the dispenser. The power source 90 may be in electrical communication with the PCB controller 84. Attachment clips 94 may secure power source 90 to propellant container 88. In at least one embodiment, power source 90 and propellant container 88 are both component elements of a removably mountable cartridge 15 and may be attached in such a manner that they are simultaneously replaceable, when a cartridge 15 is removably mounted in cartridge cavity 17 of body 14. In at least one embodiment, power source 90 and propellant container 88 are replaceable. In at least one embodiment, power source 90 is optimized so it will be depleted when propellant container 88 is expended. In at least one embodiment, propellant container 88 is optimized to be depleted when power source 90 is expended.

Fastener 96 secures power source 90 and attachment clips 94 in the correct position. In at least one embodiment fastener 96 is detachable and may comprise a portion of cartridge 15. Threaded cap 92 secures the bottom of body 14 and is detachable. Power source 90 may be a battery, a rechargeable battery, a capacitor, or the like.

Figure 10:
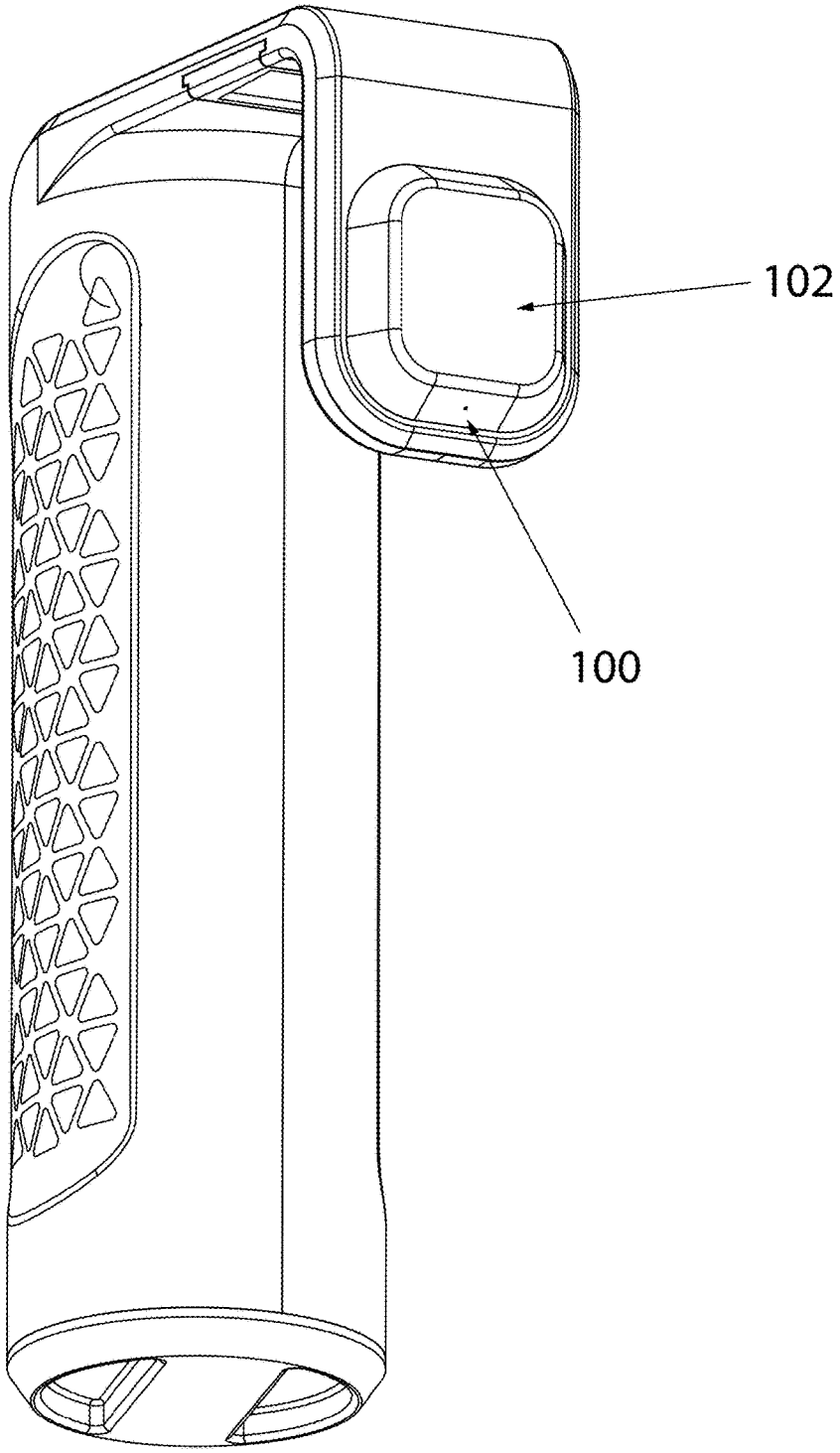
FIG. 10 illustrates an elevational view of the dispenser and light featuring the arm of the dispenser.

Referring to FIG. 10, lens 102 may be located on protrusion 30 of the head portion or arm 12 and may act as a covering for internal sensor 114 & 116 and light 112. In at least one embodiment lens 102 is transparent. In at least one embodiment lens 102 is translucent. In at least one embodiment lens 102 is not shaped to diffract light. In at least one embodiment lens 102 is shaped to diffract light into the toilet bowl 132. In various embodiments, lens 102 is biconvex, plano-convex, positive meniscus, negative meniscus, plano-concave, or biconcave.

Nozzle 100 is also located on the head portion or arm 12 of the applicator and may be the outlet, orifice and/or oil dispensing tip through which a treatment substance is discharged. In at least one embodiment, nozzle 100 sprays a treatment chemical in a diffuse manner so that it covers the liquid reservoir of a toilet bowl 132. In at least one embodiment, nozzle 100 sprays a treatment chemical at a lateral angle onto and into the liquid reservoir of a toilet bowl 132. In at least one embodiment, nozzle 100 sprays a treatment chemical in a cone shape onto and into the liquid reservoir of a toilet bowl 132. In various embodiments, nozzle 100 is a flat-fan, an even flat-fan, a hollow cone, a full cone, a twin-orifice flat-fan, a flood nozzle, or the like. In at least one embodiment, nozzle 100 is an orifice angled downwards and inward toward the liquid reservoir of a toilet bowl 132. The dispensing of treatment material may be configured and effectuated such that the material is sprayed or otherwise applied only on the surface of the toilet bowl water, thereby limiting potential product waste. The dispenser, therefore, may be oriented away from a surface of the inside of the toilet bowl. The volume of the treatment material, such as an oil based liquid barrier, may be sized to completely cover a surface area of the bowl water with the treatment material. The head portion or arm 12, which includes nozzle 100, may comprise a sealant dispenser attached to the body 14, by connecting portion 10, and may be in electrical communication with a controller, such as controller PCB 84 and/or controller PCB 110, and may be in fluid communication with a reservoir of treatment material, such as comprised by propellant container 88.

Figure 11:
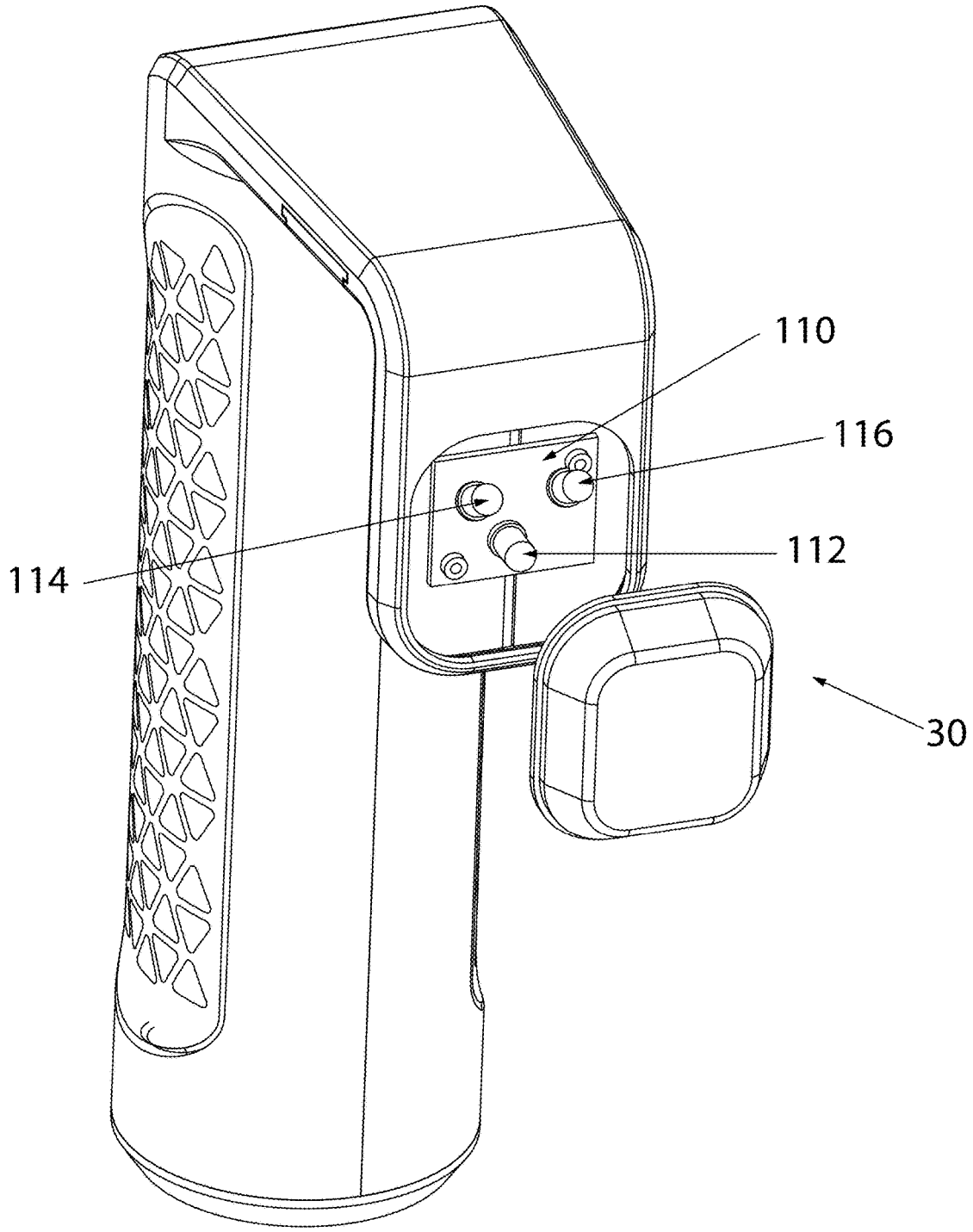
FIG. 11 illustrates an exploded view of the arm of the dispenser.

Referring to FIG. 11, light 112 may be located in protrusion 30 and provides light for a toilet bowl. In at least one embodiment, light 112 is a red, green, blue light emitting diode (LED). In various embodiments light 112 is a laser, a fluorescent light, a compact fluorescent light (CFL), incandescent light, halogen light, or the like. In at least one embodiment light 112 is communicatively connected to body PCB 84. In at least one embodiment light 112 is communicatively connected to arm PCB 110. In at least one embodiment light 112 is angled vertically downwards into a toilet bowl 132. In at least one embodiment light 112 is positioned horizontally.

Internal sensor may be an occupancy sensor located in the head portion or arm 12 of the applicator and may comprise an emitter 114 & receiver 116, wherein, in at least one embodiment, emitter 114 is an infrared emitter and receiver 116 is an infrared receiver. In the preferred embodiment, emitter 114 transmits an infrared signal and receiver 116 receives it. In at least one embodiment internal sensor 114 & 116 is an active IR sensor. In at least one embodiment internal sensor 114 & 116 detects an infrared signature. In at least one embodiment internal sensor 114 & 116 is a passive IR sensor. Internal sensor 114 & 116 may be angled upwards and inwards towards the opening of a toilet bowl 132, to act as a bowl sensor and determine when and/or whether a user is sitting on the toilet.

In at least one embodiment, arm controller PCB 110 is a control circuit that, in harmony and electrical communication with body controller PCB 84, electrically communicates with ambient sensor 22, exterior sensor 20, motor 82, internal sensor 114 & 116, light 112, light toggle 42, dispensing toggle 44, indicator 24, or the like. Again, the control circuit may be a discharge circuit programmed to discharge a spray of oil onto a water surface of the toilet bowl water upon detecting a user sitting on the toilet. In at least one embodiment, the detection of occupancy from exterior sensor 20 prompts arm controller PCB 110 to activate internal sensor 114 & 116 for a shortened period of time. In at least one embodiment internal sensor 114 & 116 are continuously activated. In at least one embodiment, the detection of occupancy from exterior sensor 20 prompts arm controller PCB 110 to activate light 112 for a shortened period of time. In at least one embodiment, the detection by ambient sensor 22 of light intensity exceeding a predetermined threshold prompts arm controller PCB 110 to prevent the activation of light 112. In at least one embodiment, the detection of occupancy by internal sensor 114 & 116 prompts arm controller PCB 110 to actuate a signal to discharge a treatment substance. In at least one embodiment, the detection of occupancy by internal sensor 114 & 116 prompts arm controller PCB 110 to actuate a signal to prevent the discharge of a treatment substance. In at least one embodiment, the pressing of dispensing toggle 42 prompts arm controller PCB 110 to immediately actuate a discharge. In at least one embodiment, the prolonged pressing of dispensing toggle 42 prompts arm controller PCB 110 to prevent a discharge for a period of time. In at least one embodiment, the pressing of light toggle 44 prompts arm controller PCB 110 to immediately activate light 112 for a period of time. In at least one embodiment, the prolonged pressing of light toggle 44 prompts arm controller PCB 110 to prevent the activation of light 112 for a period of time. In at least one embodiment, the pressing of light toggle 44 prompts arm controller PCB 110 to change the color of light 112. In at least one embodiment, illuminating or changing the color of a light associated with the dispensing apparatus may be coincident with the step of treating the surface of the bowl water with treatment material, such as an oil based liquid layer. In at least one embodiment, the detection of an expelled, or a near-expelled, propellant container prompts arm controller PCB 110 to activate indicator 24. In at least one embodiment, the detection of an expelled, or a near-expelled, propellant container prompts arm controller PCB 110 to change the color of indicator 24. Arm controller PCB 110 may work jointly with body controller PCB 84 in operation as a functional controller unit.

Figure 12:
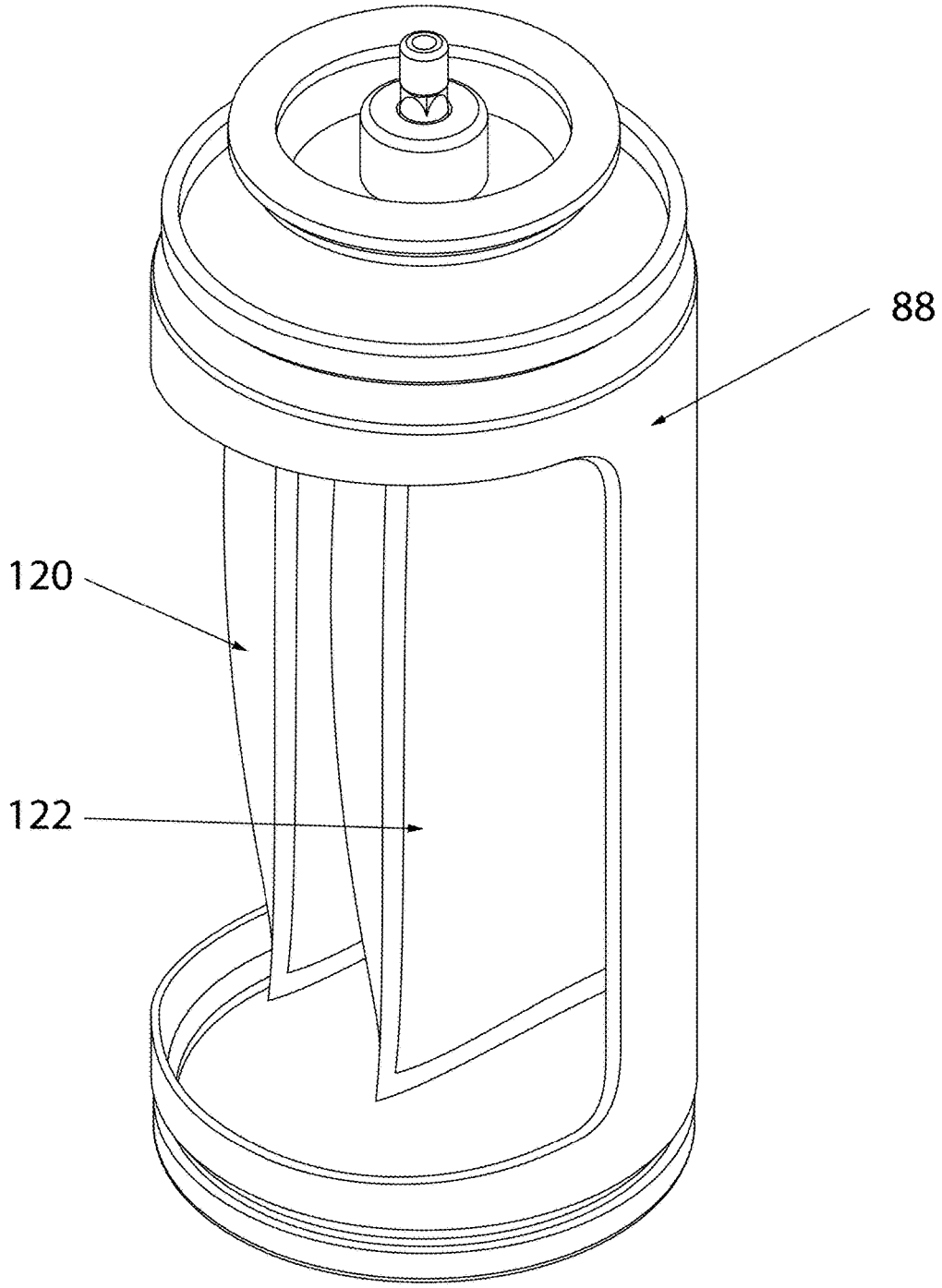
FIG. 12 illustrates a cutaway view of the propellant container.

Referring to FIG. 12, propellant container 88 may comprise a reservoir that houses a treatment substance. In at least one embodiment propellant container 88 is a component element of a removable and replaceable cartridge 15. The treatment substance housed in propellant container 88 may be a fragrance, a cleaning chemical, a water surface sealant, an oil, a volatile liquid, a liquid less dense than water, a toilet bowl cleaner, an odor-sequestering agent, or the like. Where the treatment substance, as dispensed, is an oil-based material, the overall composition may comprise oil, but does not necessarily mean that the majority of the treatment material, by volume, is oil. For example, the treatment substance may be mostly comprised of water, but may include oil-based chemicals that have polar solvent properties, where the water or other chemical compounds in the material may be non-polar solvents. In at least one embodiment, propellant container 88 houses first pouch 120 and second pouch 122. In at least one embodiment first pouch 120 houses a water mixture. In at least one embodiment second pouch 122 houses an oil mixture. In at least one embodiment the oil mixture in second pouch 122 is comprised of essential oils. In at least one embodiment the substance in first pouch 120 and the substance in second pouch 122 are combined in the discharge of the dispenser and form a water surface sealant or barrier when dispensed onto the toilet bowl water.

Figure 13:
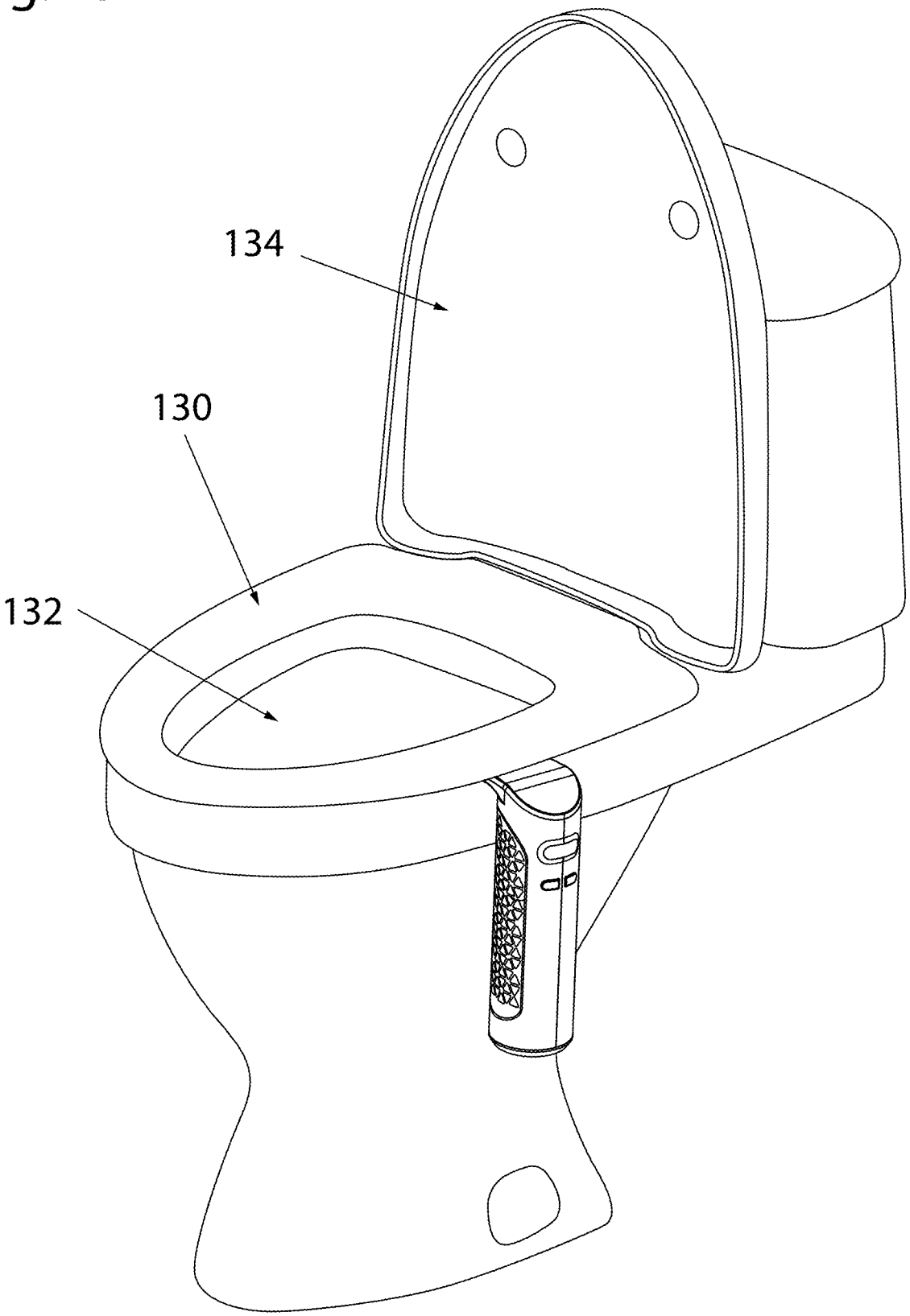
FIG. 13 is a perspective view of the dispenser positioned on the rim of a sitting toilet.

FIG. 13 shows the automatic treatment applicator dispenser and light positioned on a sitting toilet. Toilet bowl 132, toilet rim 130, and toilet lid 134 are shown for reference. The body 14 is positioned on the exterior of toilet bowl 132. Connecting portion 10 is configured in such a way to fit under a toilet seat. In a preferred embodiment, the light projected from light 112 of the head portion arm 12 reflects up from toilet bowl 132, thus leading a user to toilet bowl 132 in a dimly-lit environment. In at least one embodiment, the visible light projected from light 112 is brighter than an indicator light or sensor but dim enough to lead a user to a toilet bowl 132 without requiring the user to adjust their eyes in a darkened environment.

Figure 14:
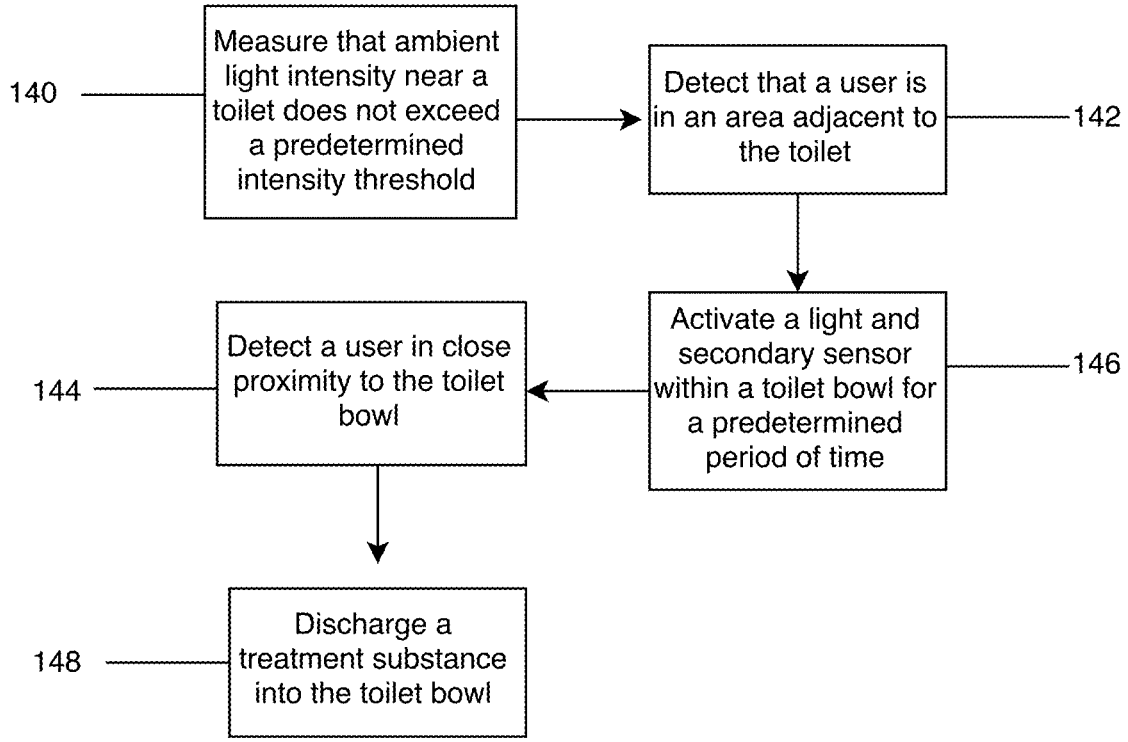
FIG. 14 is a flow diagram for the method of illuminating and treating a toilet bowl.

FIG. 14 shows a method for illuminating and treating a toilet bowl. Step 140 comprises measuring that ambient light intensity near a toilet does not exceed a predetermined intensity threshold. Following step 140 is step 142, in which a user is detected in an area adjacent to the toilet, wherein this step may be passive. Following step 142 is step 146, in which a light and secondary sensor are activated within a toilet bowl for a predetermined period of time. Following step 146 is step 144, in which a user is detected in close proximity to a toilet bowl and/or sitting on the toilet. Following step 144 is step 148, in which detection of a closely proximate or seated user triggers an actuated release of a treatment substance that is discharged into a toilet bowl to create an oil barrier on the surface of the toilet bowl water. The actuation may be initiated by a controller, wherein the controller may include a reset circuit for resetting a spray command. In at least one embodiment, an area adjacent to a toilet is an area within the range of detection of an infrared sensor. In at least one embodiment a predetermined period of time is one minute. In at least one embodiment a predetermined period of time is two to four minutes. In at least one embodiment a predetermined period of time is thirty seconds.

Figure 15:
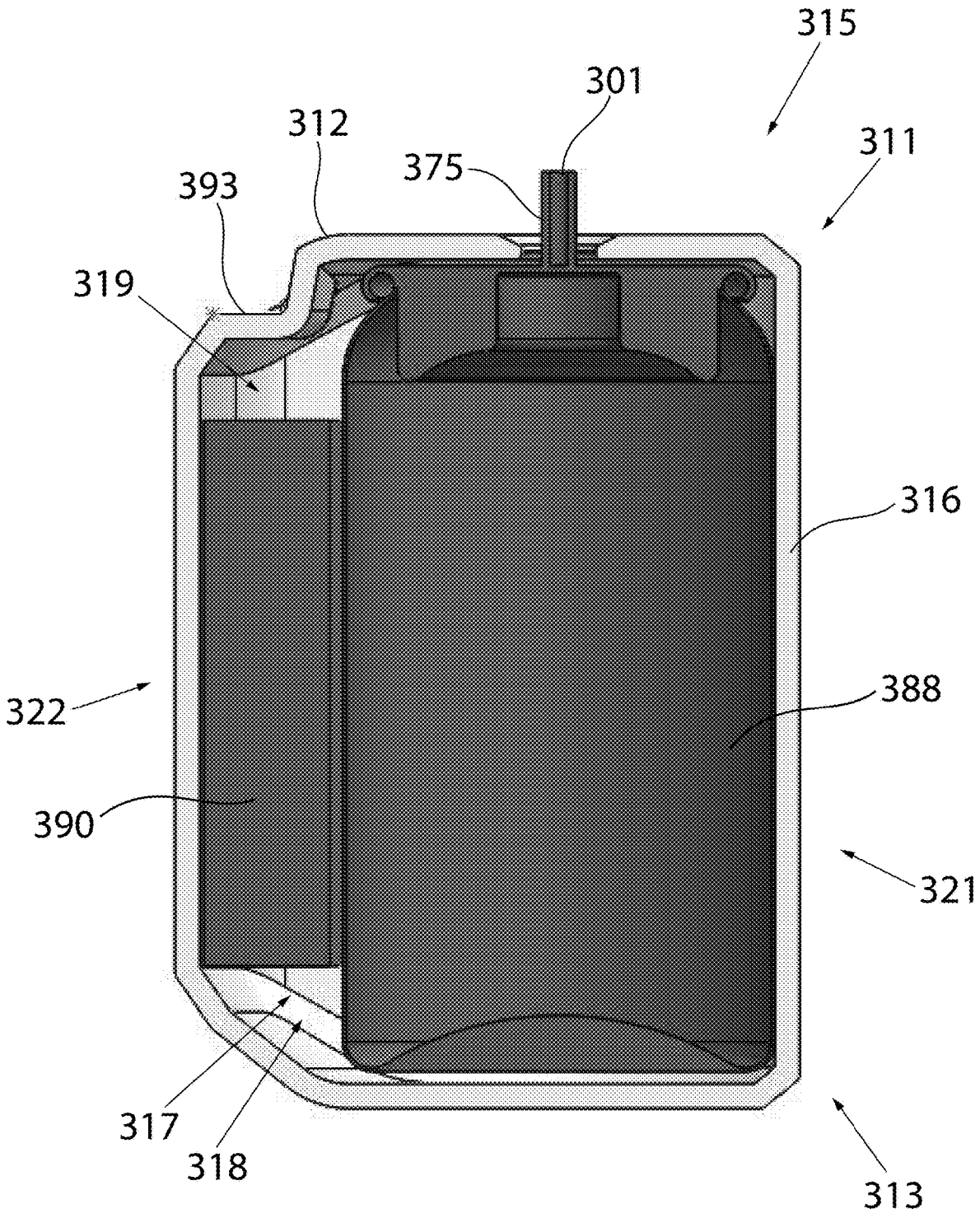
FIG. 15 is a side cutaway view of an embodiment of a replaceable cartridge.

With continued reference to the drawings, FIG. 15 depicts a side cutaway view of an embodiment of a replaceable cartridge 315. The replaceable cartridge 315 may be removably mounted to an embodiment of a toilet bowl water surface treatment applicator. For instance, the replaceable cartridge 315 may be removably secured in a cartridge cavity 17 of a body 14 of an oil based toilet water sealant device. Embodiments of a replaceable cartridge 315 may comprise a frame 316. The frame 316 may have a distal end 313, a proximal end 311, and a lateral cavity 317 located substantially between the distal end 313 and the proximal end 311 of the frame 316. A reservoir containing toilet bowl surface water treatment material, such as reservoir 388, may be removably coupled to the frame 316. The frame 316 may include a generally cylindrical section 321 and a generally rectangular section 322, wherein the reservoir 388 may be located in the cylindrical section 321 and the power contact may be located in the rectangular section 322. The treatment material housed in the reservoir may comprise an oil based toilet bowl water sealant located within the reservoir 388. Moreover, the treatment material may comprise a non-polar solvent based toilet bowl water sealant. The reservoir 388 may comprise a pressurized canister, such as a propellant container, wherein the treatment material may be stored under pressure, to help facilitate dispersion of the material. A valve, such as valve 375, may be located in fluid communication with the reservoir 388. The valve 375 may be configured to selectively release a volume of the oil based toilet bowl water sealant treatment material from the proximal end 311 of the frame 316. The oil based toilet bowl water sealant may be an essential oil. A power source, such as power source 390, may be located within the lateral cavity 317. The power source 390 may be a portable unit, such as a battery, rechargeable battery, a capacitor, or the like. The lateral cavity 317, which houses the power source 390 and the treatment material reservoir 388, may have a distal end 318 and a proximal end 319, respectively corresponding to the distal end 313 and the proximal end 311 of the frame 316. A power contact, such as contact 393, may be located at the proximal end 311 of the lateral cavity 317 and may be oriented to provide power to an external toilet bowl water treatment dispensing mechanism.

Figure 16:
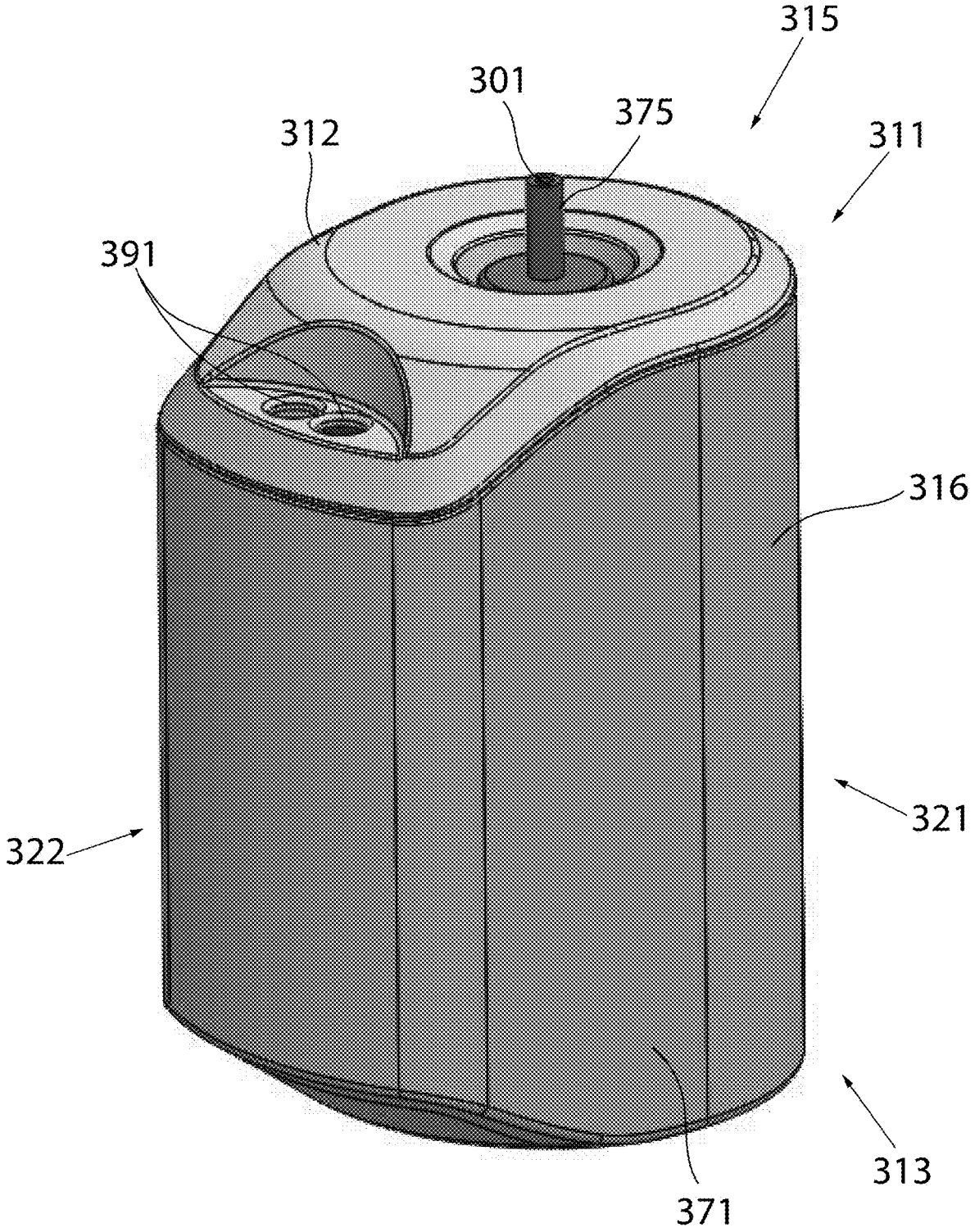
FIG. 16 is a perspective view of an embodiment of a replaceable cartridge.

As further depicted in FIG. 15 and with additional reference to FIG. 16, embodiments of a replaceable cartridge 315 may be adapted to mate with a water surface sealant applicator having a connector for mounting the applicator to a toilet bowl. As discussed herein, the applicator may further include a controller, such as controller 84 and/or controller 110, an actuator, wherein the actuator may include operable components such as a motor, gears, a solenoid, spring valves, or other like components, a sensor, such as sensors 20, 22, 114 and 116, and a cartridge receptacle, such as cartridge receptacle 17 of body portion 14. The replaceable cartridge may be configured, such that an occupancy sensor, such as sensors 114 & 166, may be in communication with the controller, wherein the controller may be programmed to control a discharge of sealant from the reservoir 388 of the cartridge 315, upon receiving an input from the occupancy sensor, such as sensors 114 & 116.

When the replaceable cartridge 315 is installed into the applicator device, a valve, such as valve 375, may be fit into mechanical communication with an actuator, for actuating the valve and selectively releasing the non-polar solvent based toilet bowl water sealant. In addition, when the cartridge 315 is installed into the applicator, a power source 390 may be fit into electrical communication with a controller of the applicator, to provide power to electronic actuators, sensor(s) and/or other electronic components. The cartridge 315 may have an upper face 312 at the proximal end 311 of the frame 316. An orifice 301 and a power contact 392 may be located on, or otherwise proximate, the upper face 312 of the cartridge 315. The power contact 393 may be substantially planar to the valve 375. The power contact 393 may be electrically connected to the power source 390 and outwardly oriented on the frame. Electrical connection between the contact 393 and electronic components of the applicator device may occur through, or otherwise be facilitated by electrical contact aperture(s) opening through a contact cover portion 397 operable with the frame 316. The frame 316 may further comprise a keying feature 371, for aligning the cartridge 315 to the external dispensing mechanism.

Figure 17:
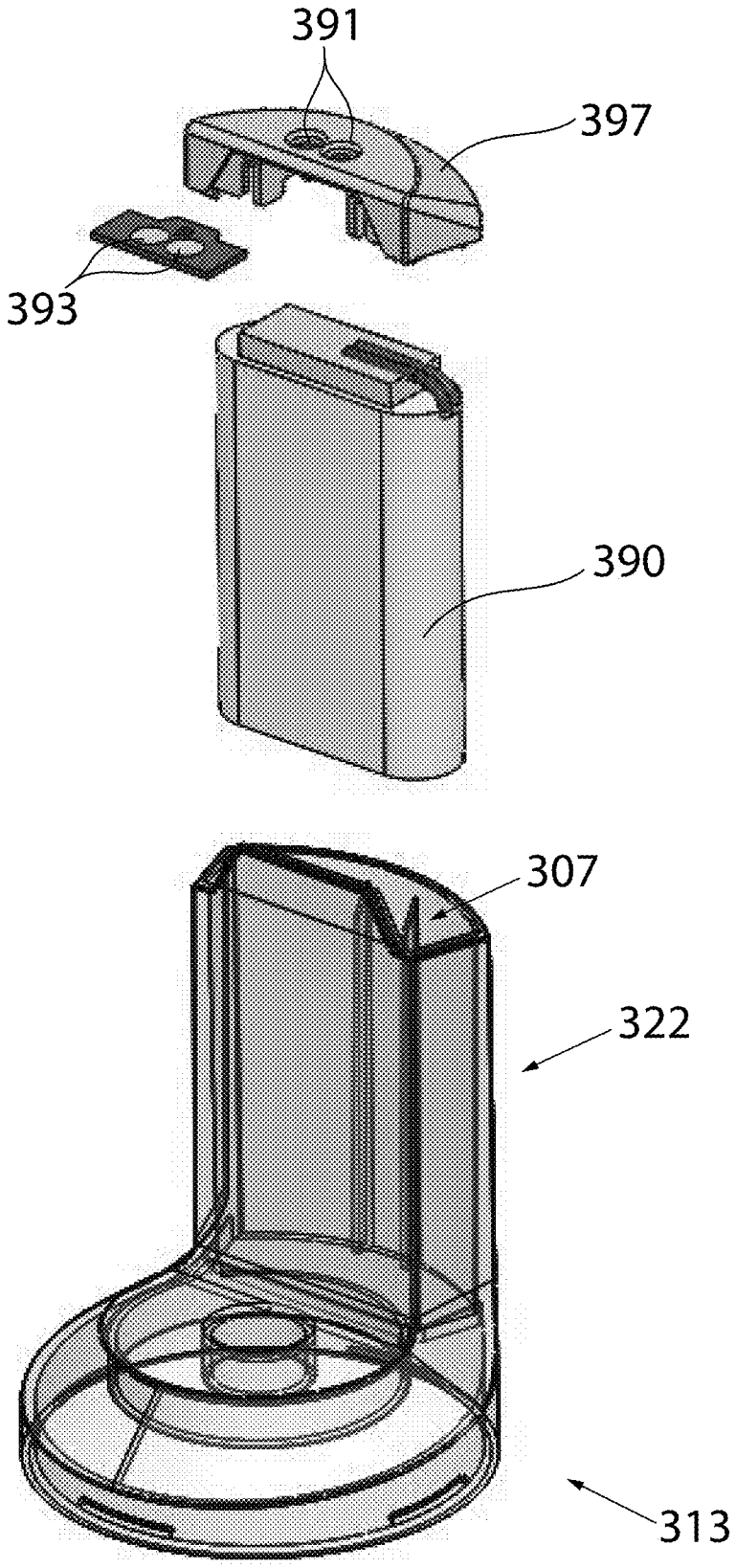
FIG. 17 is an exploded partial cutaway view of portions of an embodiment of a replaceable cartridge.

With continued reference to the drawings, FIG. 17 depicts an exploded partial cutaway view of portions of an embodiment of a replaceable cartridge 315. The rectangular portion 322 of the frame 316 may include a battery compartment 307. The battery compartment 307 may be configured to receive a power source 390, such as a battery, a rechargeable battery, or the like. When the power source 390 is received within the battery compartment, electrical contacts of the power source may be electrically connected to electrical contacts 393 of the cartridge 315, so that when the cartridge 315 is installed in a treatment applicator device, the contact apertures 391 are aligned so as to permit conductive components of the treatment applicator device to electrically connect with the electrical contacts 393 of the cartridge 315. Additionally, when the cartridge 315 is releasably mounted to the treatment applicator device, a conduit, such as conduit 50, may be in fluid communication with the orifice 301 and oriented to deliver a flow of oil based toiled bowl water sealant onto the toilet bowl water surface.

Figure 18:
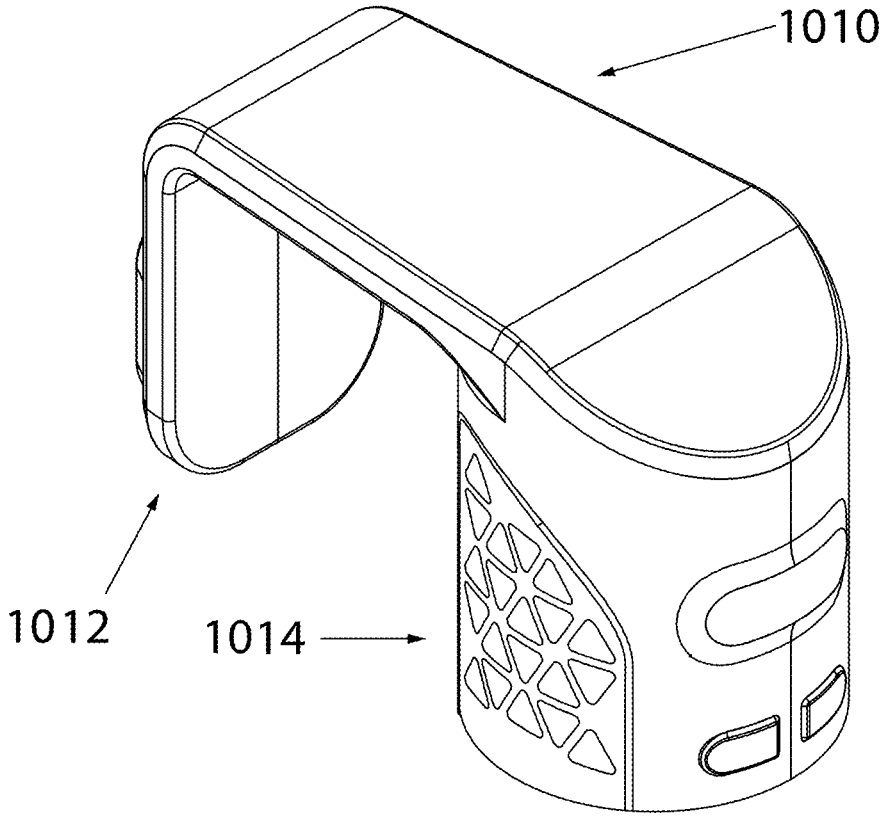
FIG. 18 illustrates an elevational view of another embodiment of the dispenser.

With further reference to the drawings, FIG. 18 shows another embodiment of a toilet bowl water surface treatment applicator comprising a connecting portion 1010 that extends from a body 1014. The connecting portion 1010 may be shaped to help attach and align the applicator to a toilet bowl. A head portion 1012, such as an arm, extends from connecting portion 1010. The connecting portion 1010, body 1014, and head portion arm 1012 are shaped in such a manner as to coincide with the geometry of a toilet, and may facilitate removable coupling of the toilet bowl water surface treatment applicator to a toilet, thereby permitting automatic dispensing of a water surface sealant onto a surface of the toilet bowl water.

Figure 19:
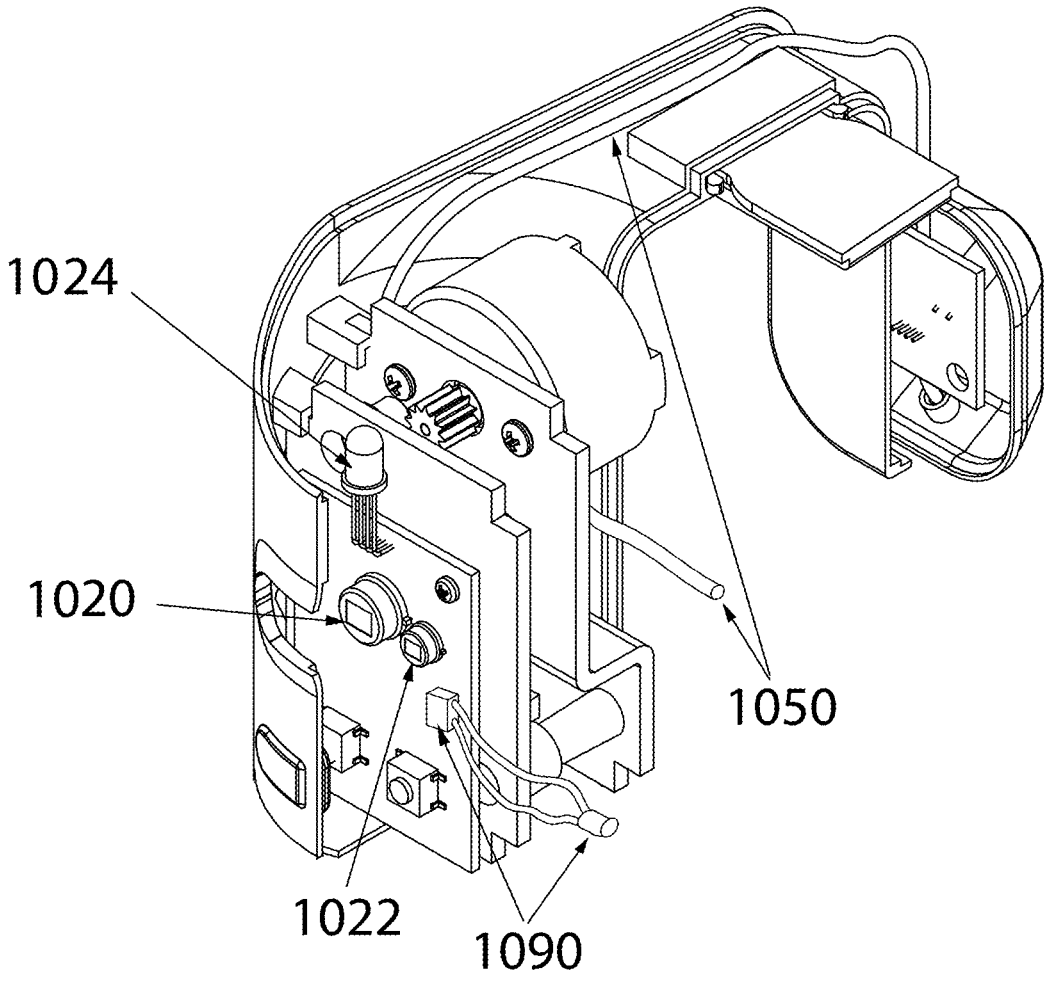
FIG. 19 illustrates a cutaway view of another embodiment of the dispenser featuring embodied sensors and an indicator light on a body of the other embodiment of the dispenser.

Referring to FIG. 19, indicator 1024 is an indicator light positioned at the top of body 1014. When indicator 1024 is in use, it shines through a transparent covering on the top of body 1014. In at least one embodiment, indicator 1024 is a red, green, and yellow light emitting diode (LED), but various other light sources may be used. Indicator 1024 may signify, through various blinking patterns and colors, that a reservoir of water surface sealant needs to be replaced, that a user has turned off the dispensing function of the dispenser for a period of time, that a user has turned on the dispensing function of the dispenser, or a that user has manually initiated an on-demand spray. The reservoir of treatment material may be housed external to the dispenser and may be fed or otherwise communicated to the dispenser through connection to conduit 1050. Moreover, electrical componentry of the dispenser may be powered by an electrical power source external to the dispenser and connected to electrical power input 1090.

Ambient sensor 1022 may detect ambient light intensity surrounding the body 1014 of the dispenser. Ambient sensor 1022 may be any form of photodetector or photosensor. In at least one embodiment ambient sensor 1022 is a photodiode, photo transistor, photoresistor, photodiode LED, or quantum dot photodetector. Ambient sensor 1022 may actuate a signal to at least one control circuit when the ambient light intensity surrounding the body of the dispenser does or does not exceed a predetermined threshold. Preferably the light intensity threshold corresponds to a dimly-lit room. In at least one embodiment the light intensity threshold is about 5 lux. In at least one embodiment the light intensity threshold is at least 5 lux. In at least one embodiment the light intensity threshold is about 10 lux. In at least one embodiment the light intensity threshold is anywhere from 5 to 100 lux. In at least one embodiment the light intensity threshold is anywhere from 100 to 1,000 lux.

Exterior sensor 1020 may detect occupancy of a user in the field of view on the exterior of body 1014. Exterior sensor 1022 may facilitate passive sensing to determine whether a user is proximate the body 1014, as removably mounted on a toilet. In at least one embodiment it is a passive infrared sensor, however exterior sensor 1020 could be any form of an occupancy sensor. Examples of these include an active infrared sensor, ultrasonic sensor, or the like. Exterior sensor 1020 may communicate with body controller PCB 1084 and/or arm controller PCB 1110, as depicted and described with regard to FIGS. 25 and 26 respectively, when occupancy of a user is detected.

Figure 20:
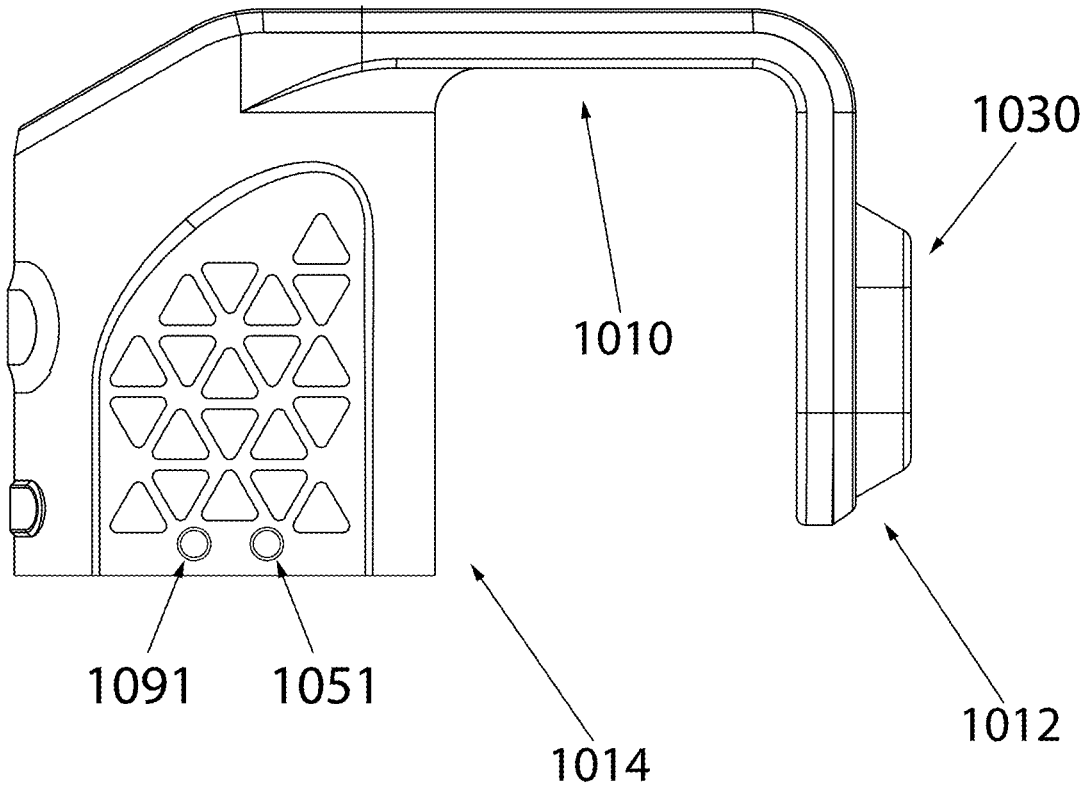
FIG. 20 illustrates a side view of another embodiment of the dispenser.

Referring to FIG. 20, a protrusion 1030 may be located on the lower portion of arm or head 1012. It may house several components that will be discussed hereafter. An electrical power source input 1091 may be located on the body, so as to permit input of electrical power from an external electrical power source. The electrical power source input 1091 may be an opening allowing electrical wires to pass therethrough or it may comprise a receptacle jack that facilitates electrical connection with a connector of an external electrical power source. A treatment material input 1051 may also be located on body 1014. The treatment material input 1051 may connect to, or otherwise be in fluid communication with, conduit 1050, thereby facilitating transport of treatment material, from a source, such as a reservoir, external to the dispenser, to the nozzle, outlet, orifice and/or oil dispensing tip 1100 through which a treatment substance is ultimately discharged. The treatment material input 1051 may be an opening allowing an externally originating tube or conduit to pass therethrough, or it may comprise a receptacle fixture that facilitates fluidic connection with a connector fixture of a tube or conduit extending from an external treatment material reservoir.

Figure 21:
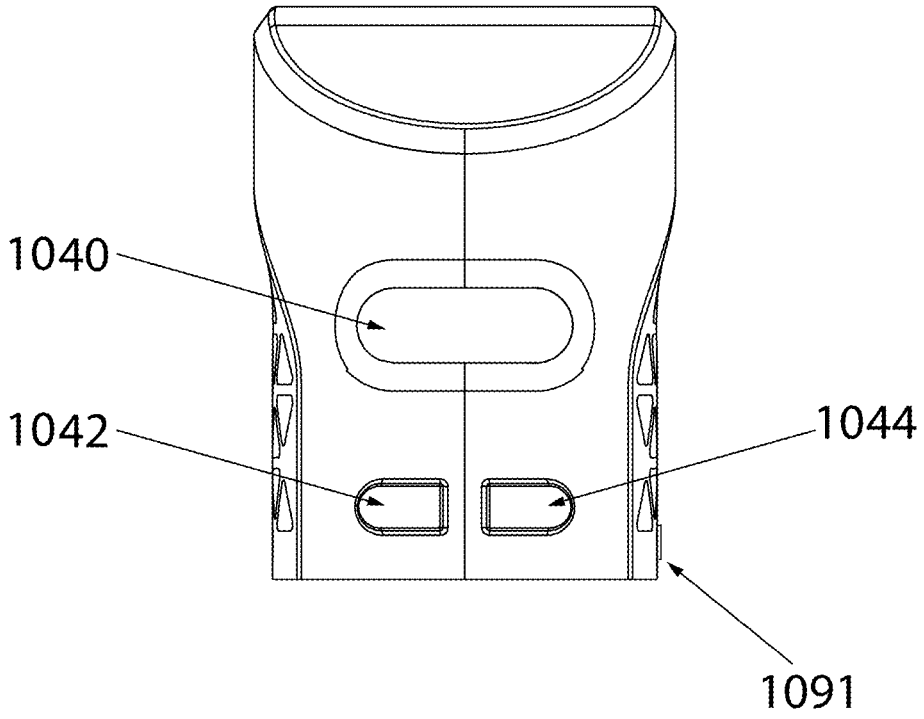
FIG. 21 illustrates a front view of another embodiment of the dispenser.

Referring to FIG. 21, the body 1014 may include a cover 1040. The cover 1040 may be a transparent cover on the outside of exterior sensor 1020 and ambient sensor 1022. Electromagnetic waves may pass through cover 1040 before being transmitted from or falling on exterior sensor 1020 or ambient light sensor 1022. The cover 1040 may comprise any transparent material that sufficiently conveys light. In at least one embodiment cover 1040 comprises a translucent material.

A light toggle 1044 may be located on body 1014 and may enable a user to manually turn on a light 1112 for a predetermined period of time, change the color of light 1112, turn off light 1112 for an extended period of time, turn off light 112 for a shortened period of time, or the like.

Moreover, a dispensing toggle 1042 may also be located on body 1014 and may enable a user to immediately discharge a treatment substance into a toilet bowl 1132 (depicted, for example, in FIG. 28), turn off a discharging function for an extended period of time, turn on a discharging function, turn off a discharging function for a shortened period of time, or the like. Both light toggle 1044 and dispensing toggle 1042 may require a user to manually push the toggle to initiate a response, however, operation of lights and/or dispensing functionality may be initiated by an external remote control device acting in harmony with controller 1084 and/or controller 1110.

Figure 22:
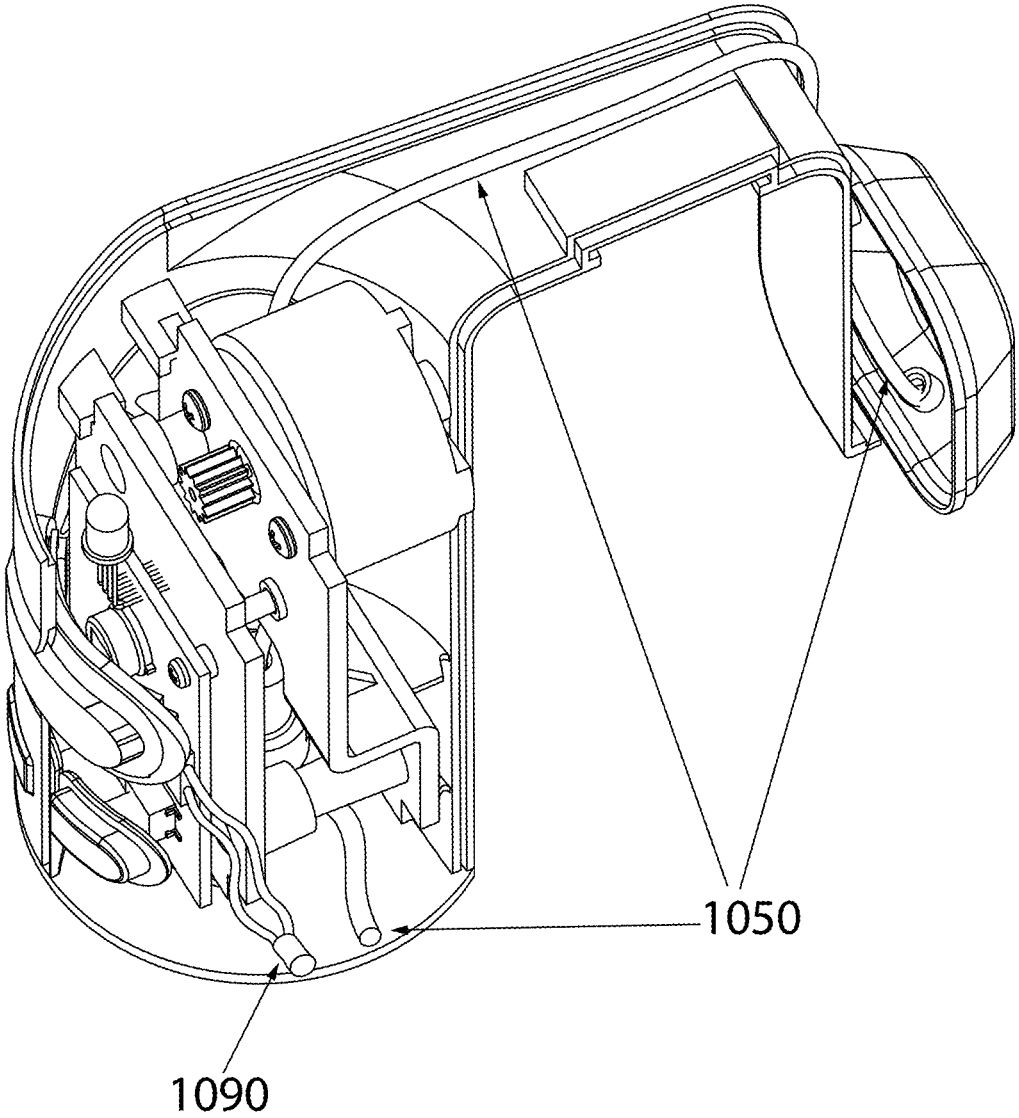
FIG. 22 illustrates a cutaway view of another embodiment of the dispenser featuring an embodied conduit and an embodied power source.

With further reference to the drawings, FIG. 22 depicts a cutaway view of an embodiment of the dispenser featuring an embodied conduit 1050 and an embodied power source 1090. The conduit 1050 may fluidly connect to one or more external conduits (such as external conduit 1058 depicted in FIG. 28) and/or to one or more external reservoirs (such as external reservoir 1088 depicted in FIG. 29). The conduit 1050 may run to dispensing nozzle tip or orifice 1100, thereby facilitating transport of treatment substances, such as water surface sealant or fragrances, from the external reservoir(s) to the dispensing nozzle tip or orifice 1100. Wiring for electrical power or signal transmission may also run along conduit 1050, to facilitate electrical communication between the controller 1084 and/or the controller 1100 and/or with an external controller, and or with all controllers in harmony and operable as a joint controller. However, communications between internal controllers and/or between internal controller(s) and external controller(s) may also be wirelessly effectuated. As embodied, the power source 1090 may be an extension into the body 1014 from a power source originating external to the dispensing apparatus (such as power source 1090 depicted in FIG. 29). Electrical power may be provided by direct wiring to an external electrical power circuit and/or by a plug-in connection to an electrical power outlet external to the dispenser. For example, external electrical power extension to the power source 1090 may be facilitated by a connector associated with electrical power source input 1091 or by an electrical wire running directing into and through the power source input 1091. Characteristics, such as amperage, voltage, etc., of the electrical power pertaining to electrical power source 1090 may be modified, if necessary, by electrical componentry located within the body 1014 of the treatment applicator, or may be modified by electrical componentry external to the treatment applicator.

Figure 23:
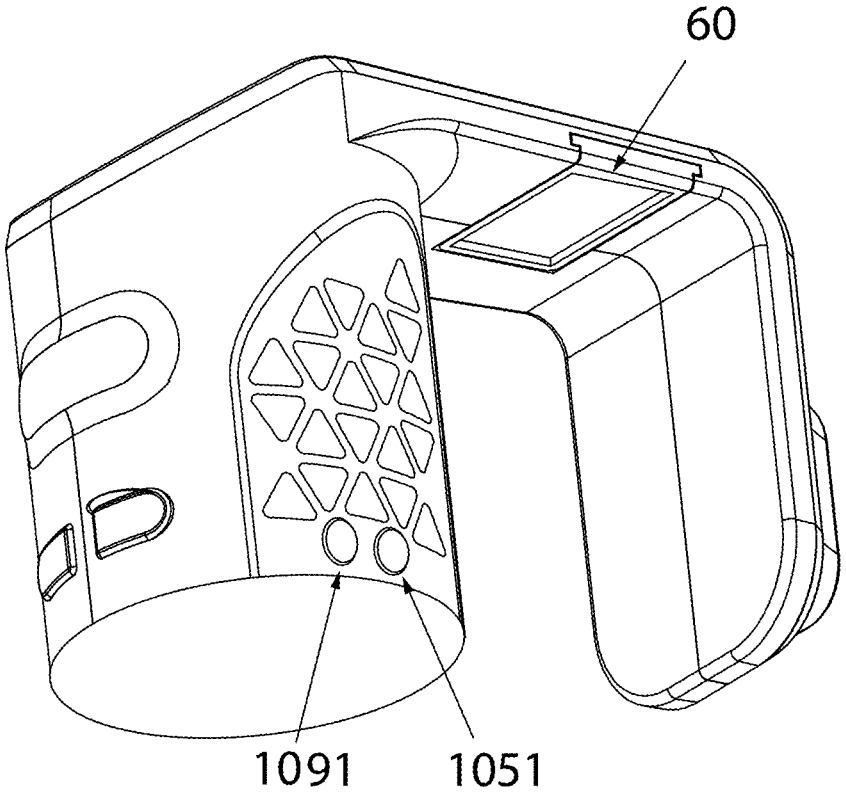
FIG. 23 illustrates an elevational view of another embodiment of the dispenser featuring a mounting clip inserted.

Referring to FIG. 23, mounting clip 60 may be configured in size and shape to detachably connect to connecting portion 1010. In at least one embodiment, mounting clip 60 attaches to a toilet bowl 1132 through adhesives. In at least one embodiment mounting clip 60 attaches to a toilet bowl 1132 through suction. In at least one embodiment, mounting clip 60 is replaceable. In at least one embodiment mounting clip 60 emits fragrances.

Figure 24:
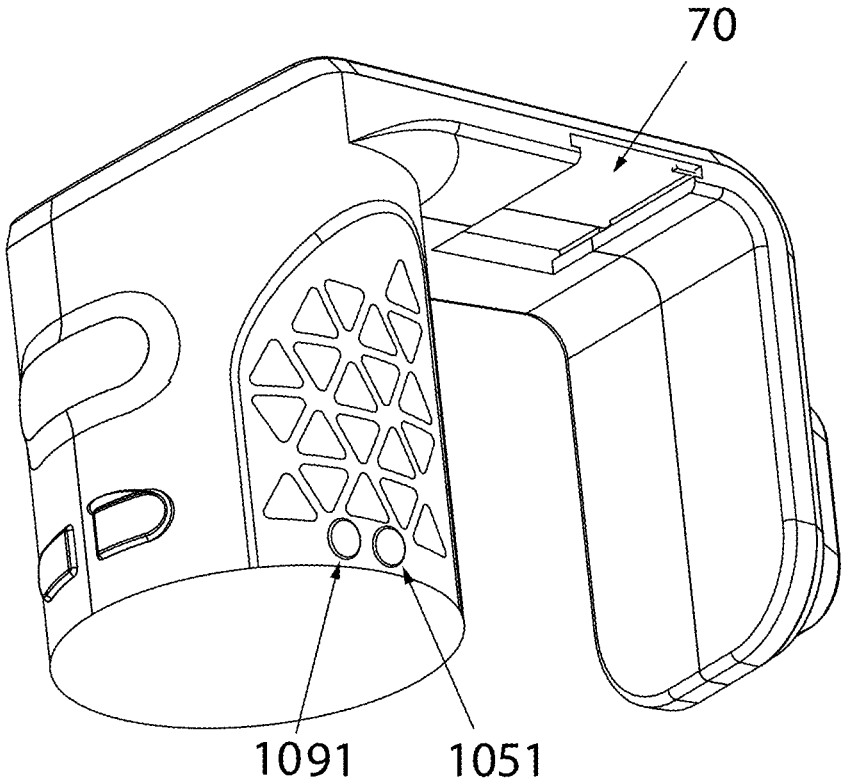
FIG. 24 illustrates an elevational view of another embodiment of the dispenser featuring a groove with the mounting clip removed.

In reference to FIG. 24, a mounting clip groove 70 may be located on connecting portion 1010 of the applicator for dispensing treatment material, and may facilitate the attachment of mounting clip 60 to connecting portion 1010. In at least one embodiment, mounting clip groove 70 contains a locking portion to secure mounting clip 60 to mounting clip groove 70. In at least one embodiment mounting clip groove 70 contains magnetic strips that correspond to magnetic portions on mounting clip 60, thus securing mounting clip 60 to mounting clip groove 70. In at least one embodiment, mounting clip groove 70 and mounting clip 60 correspondingly fit together in a complementary fashion such as through a sliding dovetail, dado, dovetail, tongue and groove, or the like.

Figure 25:
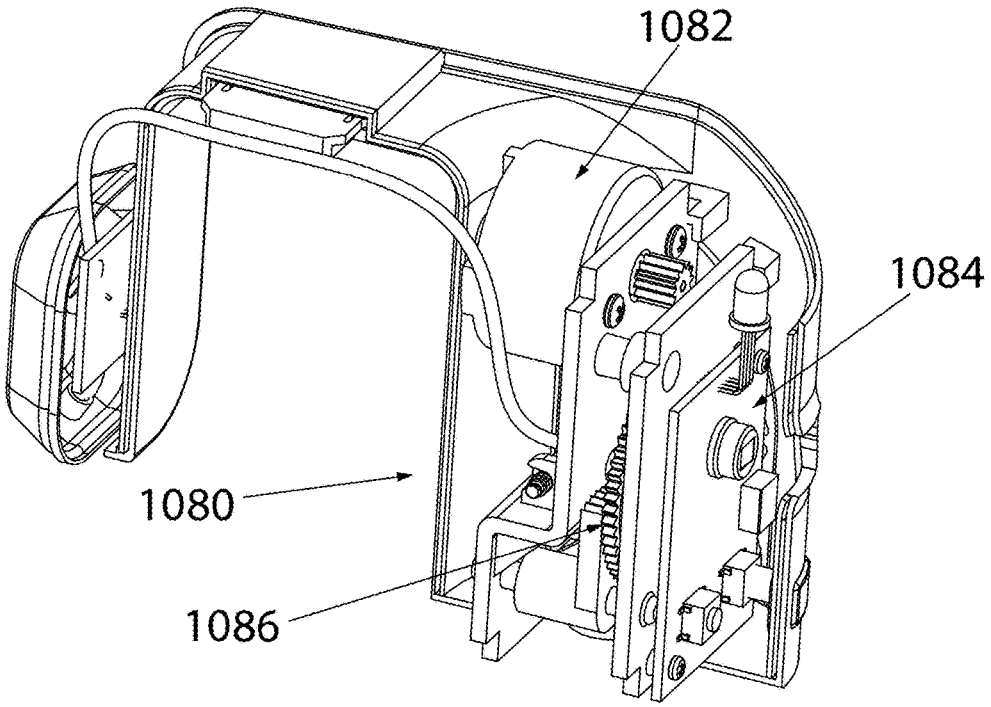
FIG. 25 illustrates a cutaway view of another embodiment of the dispenser featuring internal mechanics.

With further reference to the drawings, FIG. 25 depicts a cutaway view of an embodiment of the applicator for dispensing treatment material featuring internal mechanics 1080. The internal mechanics 1080 may be housed within the body of the dispensing applicator. The internal mechanics 1080 may work in harmony to actuate a discharge of treatment material originating from an external reservoir and conveyed through conduit 1050. A motor 1082 may be electrically connected to power source 1090. The motor 1082 may drive internal gears 1086 to help actuate a discharge, or the motor 1082 may operate with or as a solenoid to open or close valves possibly configured or located for controlling the release and/or dispensing of treatment material. In at least one embodiment, body PCB 1084 is a controller comprising a control circuit that, as further depicted and described in harmony with head portion controller PCB 1110 shown in FIG. 27, and may electrically communicate with ambient sensor 1022, exterior sensor 1020, motor 1082, internal sensor 1114 & 1116, light 1112, light toggle 1042, dispensing toggle 1044, indicator 1024, and/or a remote controller located external to the dispensing applicator, and/or the like. In at least one embodiment, the detection of occupancy from exterior sensor 1020 prompts body controller PCB 1084 to activate internal sensor 1114 & 1116 for a shortened period of time. In at least one embodiment internal sensor 1114 & 1116 are always activated. In at least one embodiment, the detection of occupancy from exterior sensor 1020 prompts body controller PCB 1084 to activate light 1112 for a shortened period of time. In at least one embodiment, the detection by ambient sensor 1022 of light intensity exceeding a predetermined threshold prompts body controller PCB 1084 to prevent the activation of light 1112. In at least one embodiment, the detection of occupancy by internal sensor 1114 & 1116 prompts body controller PCB 1084 to actuate a signal to discharge a treatment substance. In at least one embodiment, the detection of occupancy by exterior sensor 1020 prompts body controller PCB 1084 to actuate a signal to discharge a treatment substance. In at least one embodiment, the pressing of dispensing toggle 1042 prompts body controller PCB 1084 to immediately actuate a discharge. In at least one embodiment, the prolonged pressing of dispensing toggle 1042 prompts body controller PCB 1084 to prevent a discharge for a period of time. In at least one embodiment, the pressing of light toggle 1044 prompts body controller PCB 1084 to immediately activate light 1112 for a period of time. In at least one embodiment, the prolonged pressing of light toggle 1044 prompts body controller PCB 1084 to prevent the activation of light 1112 for a period of time. In at least one embodiment, the pressing of light toggle 1044 prompts body controller PCB 1084 to change the color of light 1112. In at least one embodiment, the detection of a low or non-existent pressure or flow-rate associated with treatment material from an external reservoir prompts body connector PCB 1084 to activate indicator 1024. In at least one embodiment, the detection of a low or non-existent pressure or flow-rate associated with treatment material from an external reservoir prompts body controller PCB 1084 to change the color of indicator 1024. Activation of lights or dispensing functionality may be initiated by a remote control connected either wirelessly or by wired connection to controller PCB 1084 and/or controller PCB 1110.

Figure 26:
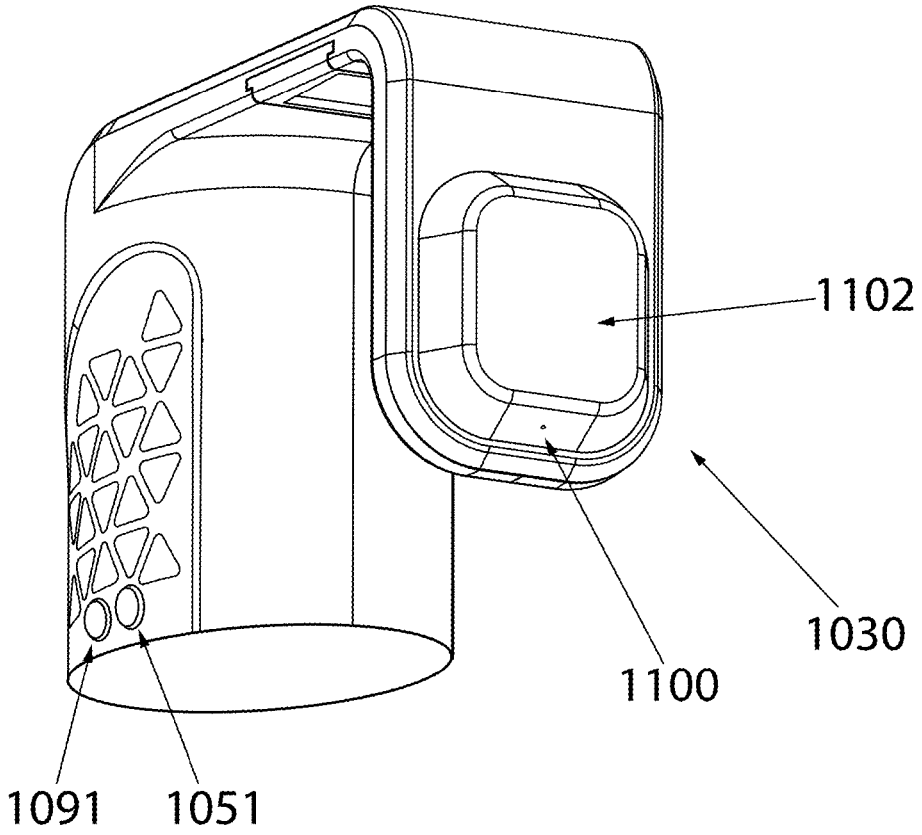
FIG. 26 illustrates an elevational view of another embodiment of the dispenser and featuring an embodiment of a head portion or arm of the dispenser.

Referring to FIG. 26, lens 1102 may be located on protrusion 1030 of the head portion or arm 1012 and may act as a covering for internal sensor 1114 & 1116 and light 112. In at least one embodiment lens 1102 is transparent. In at least one embodiment lens 1102 is translucent. In at least one embodiment lens 1102 is not shaped to diffract light. In at least one embodiment lens 1102 is shaped to diffract light into the toilet bowl 1132. In various embodiments, lens 1102 is biconvex, plano-convex, positive meniscus, negative meniscus, plano-concave, or biconcave.

Nozzle 1100 is also located on the head portion or arm 1012 of the applicator and may be the outlet, orifice and/or oil dispensing tip through which a treatment substance is discharged. In at least one embodiment, nozzle 1100 sprays a treatment chemical in a diffuse manner so that it covers the liquid reservoir of a toilet bowl 1132. In at least one embodiment, nozzle 1100 sprays a treatment chemical at a lateral angle onto and into the liquid reservoir of a toilet bowl 1132. In at least one embodiment, nozzle 1100 sprays a treatment chemical in a cone shape onto and into the liquid reservoir of a toilet bowl 1132. In various embodiments, nozzle 1100 is a flat-fan, an even flat-fan, a hollow cone, a full cone, a twin-orifice flat-fan, a flood nozzle, or the like. In at least one embodiment, nozzle 1100 is an orifice angled downwards and inward toward the liquid reservoir of a toilet bowl 1132. The dispensing of treatment material may be configured and effectuated such that the material is sprayed or otherwise applied only on the surface of the toilet bowl water, thereby limiting potential product waste. The dispenser, therefore, may be oriented away from a surface of the inside of the toilet bowl. The volume of the treatment material, such as an oil based liquid barrier, may be sized to completely cover a surface area of the bowl water with the treatment material. The head 1012, which includes nozzle 1100, may comprise a sealant dispenser attached to the body 1014, by connecting portion 1010, and may be in electrical communication with a controller, such as controller PCB 1084 and/or controller PCB 1110, and may be in fluid communication with an external reservoir of treatment material.

Figure 27:
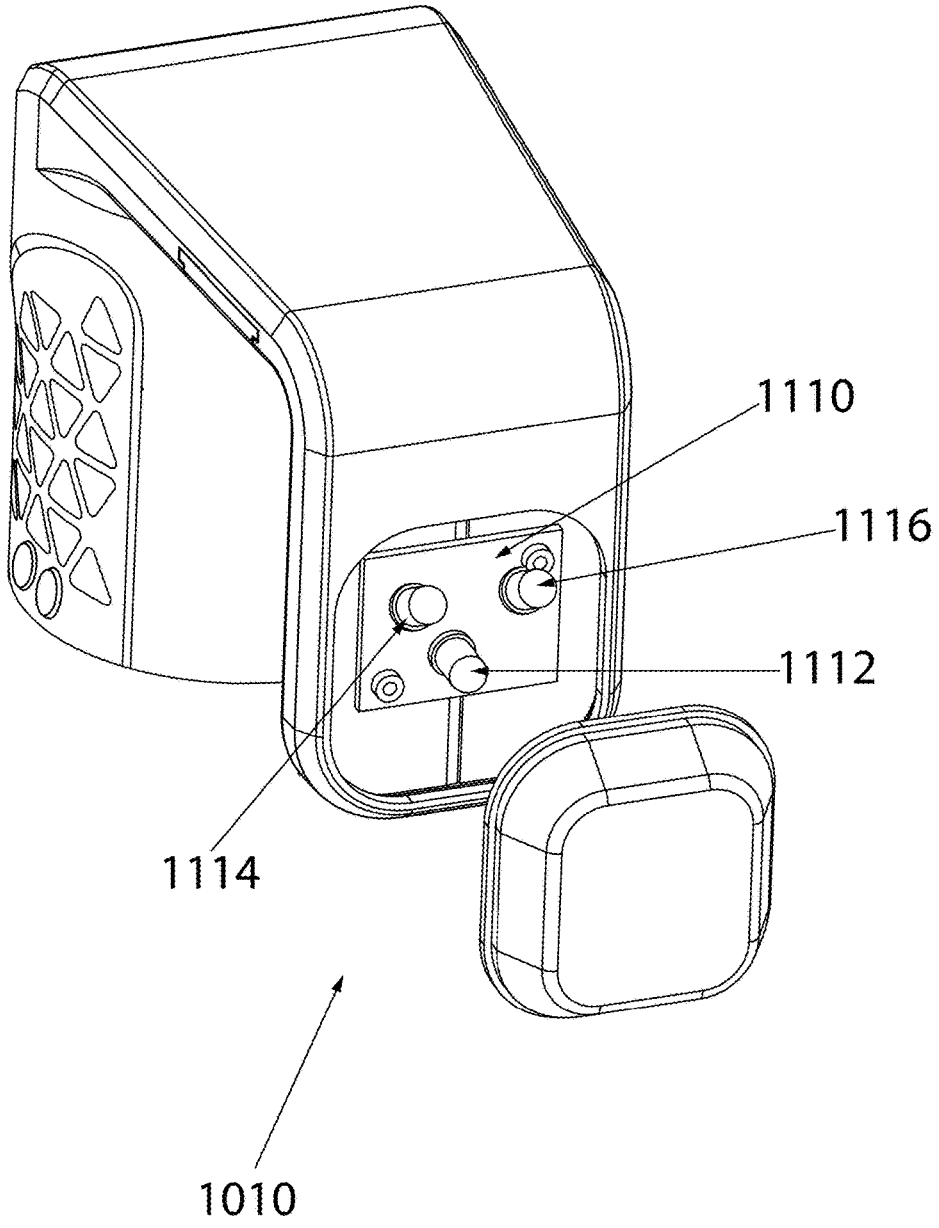
FIG. 27 illustrates an exploded view of an embodiment of a head of another embodiment of the dispenser.

Referring to FIG. 27, light 1112 may be located in protrusion 1030 and may provide light for a toilet bowl. In at least one embodiment, light 1112 is a red, green, blue light emitting diode (LED). In various embodiments light 1112 is a laser, a fluorescent light, a compact fluorescent light (CFL), incandescent light, halogen light, or the like. In at least one embodiment light 1112 is communicatively connected to body controller PCB 1084. In at least one embodiment light 1112 is communicatively connected to arm controller PCB 1110. In at least one embodiment light 1112 is angled vertically downwards into a toilet bowl 1132. In at least one embodiment light 1112 is positioned horizontally.

Embodiments of the dispensing applicator may include an internal sensor such as an occupancy sensor, located in the arm or head portion 1012 of the applicator and may comprise an emitter 1114 & receiver 1116, wherein, in at least one embodiment, emitter 1114 is an infrared emitter and receiver 1116 is an infrared receiver. In an embodiment, emitter 1114 transmits an infrared signal and receiver 1116 receives it. In at least one embodiment internal sensor 1114 & 1116 is an active IR sensor. In at least one embodiment internal sensor 1114 & 1116 detects an infrared signature. In at least one embodiment internal sensor 1114 & 1116 is a passive IR sensor. Internal sensor 1114 & 1116 may be angled upwards and inwards towards the opening of a toilet bowl 1132, to act as a bowl sensor and determine when and/or whether a user is sitting on the toilet.

In at least one embodiment, arm or head portion controller PCB 1110 is a control circuit that, in harmony and electrical communication with body controller PCB 1084, may electrically communicate with ambient sensor 1022, exterior sensor 1020, motor 1082, internal sensor 1114 & 1116, light 1112, light toggle 1042, dispensing toggle 1044, indicator 1024, and/or a remote controller located external to the dispensing applicator, and/or the like. In at least one embodiment, the detection of occupancy from exterior sensor 1020 prompts arm or head portion controller PCB 1110 to activate internal sensor 1114 & 1116 for a shortened period of time. In at least one embodiment internal sensors 1114 & 1116 are continuously activated. In at least one embodiment, the detection of occupancy from exterior sensor 1020 prompts arm or head portion controller PCB 1110 to activate light 1112 for a shortened period of time. In at least one embodiment, the detection by ambient sensor 1022 of light intensity exceeding a predetermined threshold prompts arm or head portion controller PCB 1110 to prevent the activation of light 1112. In at least one embodiment, the detection of occupancy by internal sensors 1114 & 1116 prompts arm or head portion controller PCB 1110 to actuate a signal to discharge a treatment substance. In at least one embodiment, the detection of occupancy by internal sensor 1114 & 1116 prompts arm or head portion controller PCB 1110 to actuate a signal to prevent the discharge of a treatment substance. In at least one embodiment, the pressing of dispensing toggle 1042 prompts arm or head portion controller PCB 1110 to immediately actuate a discharge. In at least one embodiment, the prolonged pressing of dispensing toggle 1042 prompts arm or head portion controller PCB 1110 to prevent a discharge for a period of time. In at least one embodiment, the pressing of light toggle 1044 prompts arm or head portion controller PCB 1110 to immediately activate light 1112 for a period of time. In at least one embodiment, the prolonged pressing of light toggle 1044 prompts arm or head portion controller PCB 1110 to prevent the activation of light 1112 for a period of time. In at least one embodiment, the pressing of light toggle 1044 prompts arm or head portion controller PCB 1110 to change the color of light 1112. In at least one embodiment, illuminating or changing the color of a light associated with the dispensing apparatus may be coincident with the step of treating the surface of the bowl water with treatment material, such as an oil based liquid layer. In at least one embodiment, the detection of a low or non-existent pressure or flow-rate associated with treatment material from an external reservoir prompts arm or head portion controller PCB 1110 to activate indicator 1024. In at least one embodiment, the detection of a low or non-existent pressure or flow-rate associated with treatment material from an external reservoir prompts arm or head controller PCB 1110 to change the color of indicator 1024. Arm or head portion controller PCB 1110 may work jointly with body controller PCB 1084 in operation as a functional controller unit. Moreover, both the arm or head portion controller PCB 1110 and the body controller PCB 1084 may work separately and/or jointly with a controller that is located external to the dispensing applicator, such that all jointly operational controllers may function as a single controller unit.

Figure 28:
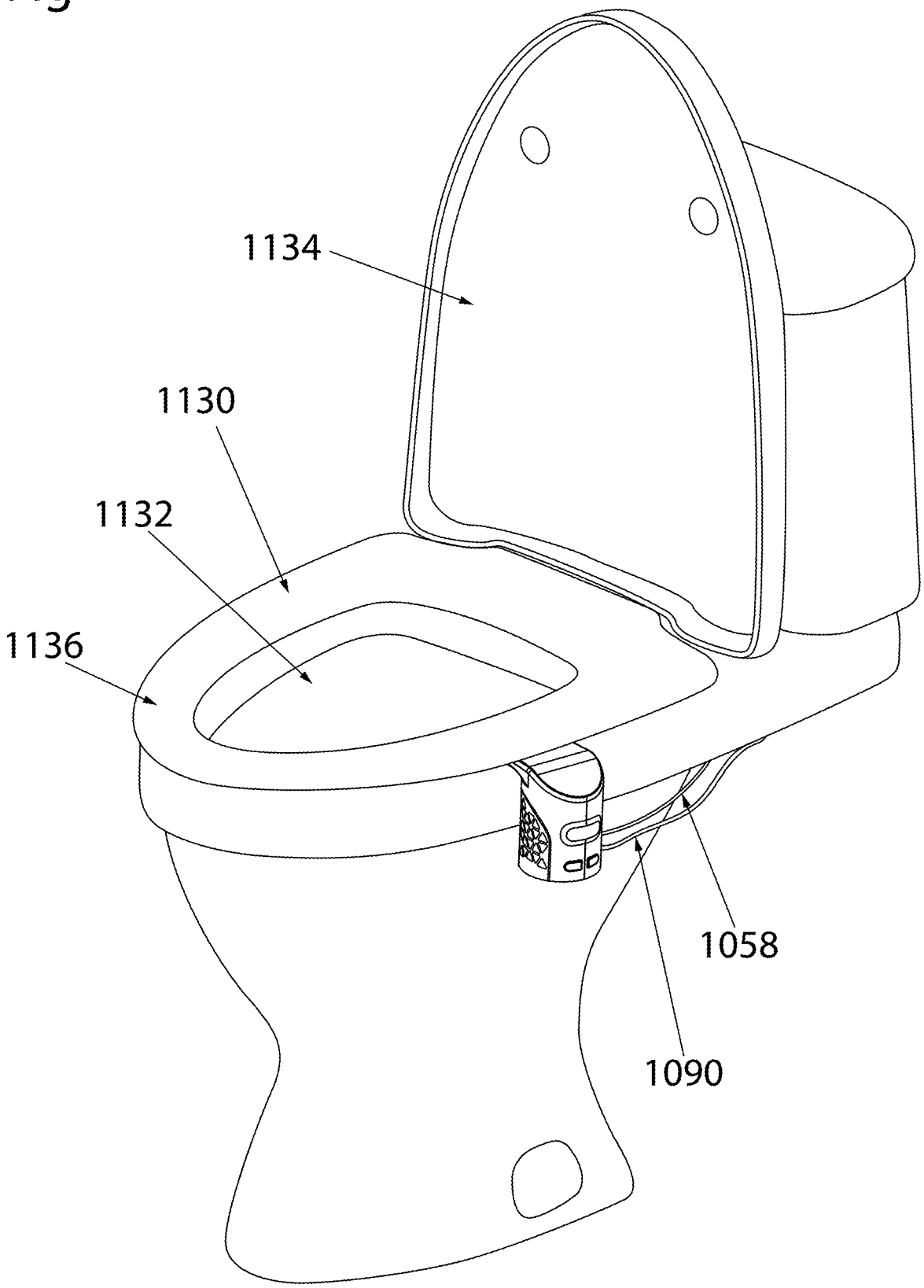
FIG. 28 is a perspective view of another embodiment of the dispenser positioned on a rim of an embodiment of a sitting toilet.

With further reference to the drawings, FIG. 28 shows a perspective view of an embodiment of the dispensing applicator positioned on a sitting toilet. Toilet bowl 1132, toilet rim 1130, toilet lid 1134 and toilet seat 1136 are shown for reference. The body 1014 of the dispensing applicator is positioned on the exterior of toilet bowl 1132. Connecting portion 1010 is configured in such a way to fit on top of the toilet rim 1130 and under the toilet seat 1136. In an embodiment, the light that may be projected from light 1112 of the head portion 1012 of the dispensing applicator reflects up from toilet bowl 1132, thus leading a user to toilet bowl 1132 in a dimly-lit environment. In at least one embodiment, the visible light projected from light 1112 is brighter than an indicator light or sensor but dim enough to lead a user to a toilet bowl 1132 without requiring the user to adjust their eyes in a darkened environment.

Figure 29:
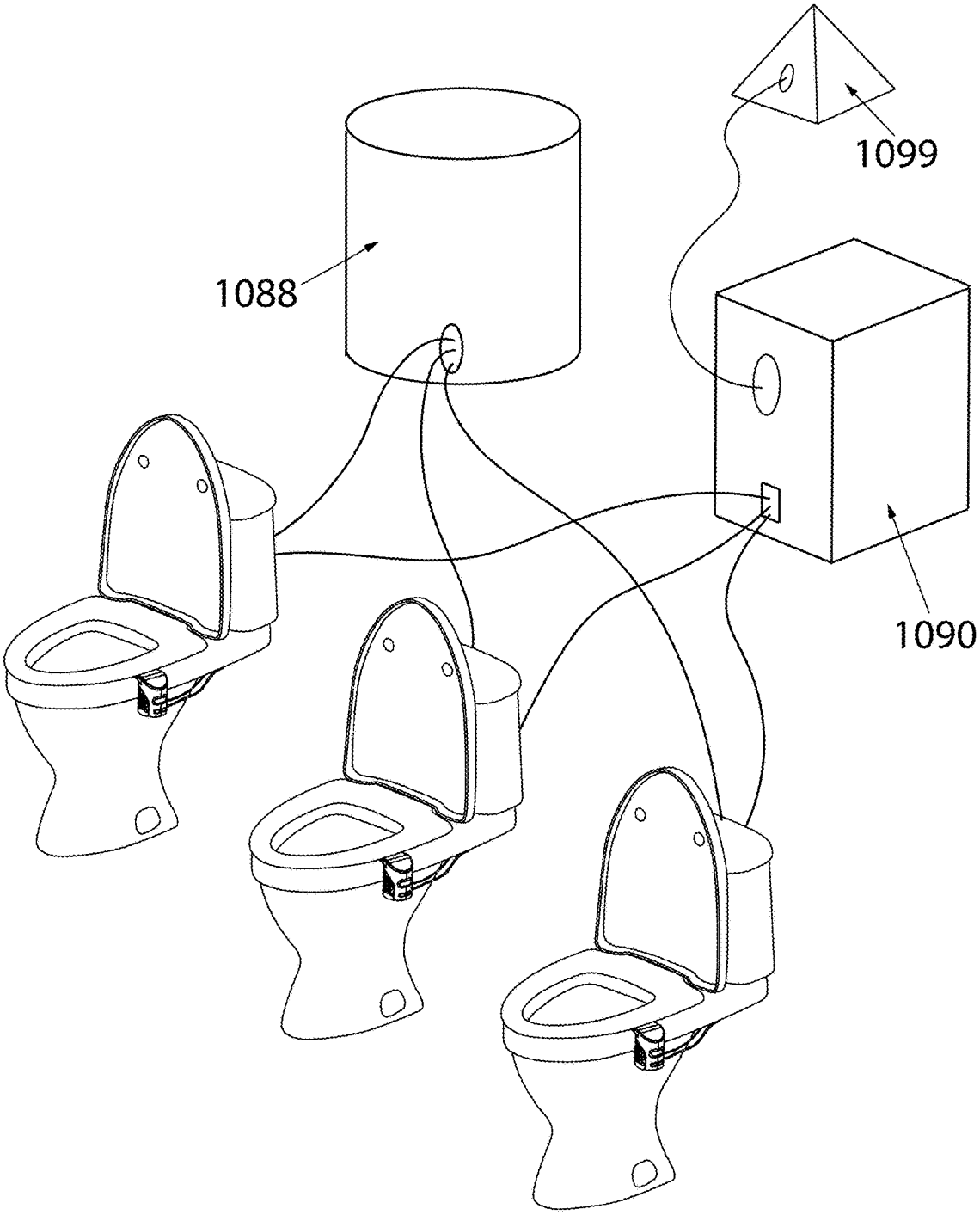
FIG. 29 is a schematic perspective view of a plurality of embodied dispensers mounted on a plurality of toilets in cooperation with embodiments of an external power source and an external treatment substance reservoir.

Referring further to FIG. 28 and additionally to FIG. 29, an external conduit 1058 may extend from a dispensing applicator to facilitate transport of treatment material to the dispensing applicator from one or more reservoirs, such as reservoir 1088, located external to the dispensing applicator. The one or more external reservoirs, such as reservoir 1088, may include treatment materials such as water surface sealant or fragrances and may be in fluidic communication with external conduit 1058. The external reservoir(s), such as reservoir 1088, may comprise any form of container that houses liquids and/or gasses. In at least one embodiment, an external reservoir 1088 is pressurized. In at least one embodiment, an external reservoir 1088 houses multiple containers, wherein each container includes a separate treatment material. The treatment substance(s) housed in an external reservoir 1088 may be a fragrance, a cleaning chemical, a water surface sealant, an oil, a volatile liquid, a liquid less dense than water, a toilet bowl cleaner, an odor-sequestering agent, or the like. Where the treatment substance, as dispensed, is an oil-based material, the overall composition may comprise oil, but does not necessarily mean that the majority of the treatment material, by volume, is oil. For example, the treatment substance may be mostly comprised of water, but may include oil-based chemicals that have polar solvent properties, where the water or other chemical compounds in the material may behave more significantly as non-polar solvents. In at least one embodiment multiple treatment substances in separate containers housed in an external reservoir 1088 are combined either prior to or during the discharge of the dispenser and form a water surface sealant or barrier when dispensed onto the toilet bowl water.

A power source, such as power source 1090, may provide power for electronic components of an applicator for dispensing treatment material. The power source 1090 may originate from a source external to the dispensing applicator. Ultimately, the external power source may be a common electrical grid comprising a typical interconnected network for delivering electricity generated by power stations and communicated through standard transmission lines. A wired or a plug/receptacle connection may operate with an electrical power input 1091 (see FIGS. 20-21, 23-24 and 26) to convey electrical power from an external power source 1090 to electrical components within the dispensing applicator.

With further reference to FIG. 29, a system of multiple dispensing applicators mounted respectively on multiple toilets may each and all be connected to a single external reservoir 1088 for access to treatment material. Moreover, the multiple dispensing applicators mounted respectively on the multiple toilets may each and all be connected to a single external power source 1090 to provide power for electrical components of each of the dispensing applicators. An advantage of such a system is that a single reservoir may be able to facilitate dispensing of treatment material by multiple applicators mounted on multiple toilets, thereby reducing the need to fill, replace or otherwise manage multiple treatment material reservoirs corresponding to each toilet. Another advantage may be associated with having the reservoir(s) located in position away from the toilets, such as in a cabinet, a closet, or another room, thereby facilitating maintenance or refill of treatment material in a discreet and non-interruptive manner. A further advantage of such a system may be a reduction in maintenance associated with periodic battery replacement for each dispensing applicator, since electrical power may be provided by a common electrical power grid.

As further depicted in FIG. 29, an external controller 1099 may be in operable communication with one or more of the multiple automatic treatment dispensing devices respectively mounted on the one or more toilets. The communication between the external controller 1099 and the one or more automatic treatment dispensing devices may be effectuated wirelessly or may transpire through wired connection. The external controller 1099 may be powered by external power source 1090, or it may be powered by a separate external power source or may rely on internal battery power. The external controller 1099 may work in harmony with controllers, such as body controller 1084 and/or head portion controller 1110, within the automatic treatment dispensing device(s), to control operations of the device(s). The external controller 1099 may detect operational status of the automatic treatment device(s). For example, the external controller may detect and facilitate the storage of data pertaining to operations such as when an automatic dispensing device discharges dispensing material, when any sensor of an automatic dispensing device is triggered, when any toggle or switch of an automatic dispensing device is activated, whether lights of an automatic dispensing device are properly working, and/or whether appropriate amounts of treatment material are discharged during operation of an automatic treatment dispenser, and/or other like dispenser operations. In addition, an external controller 1099 may function with a graphical user interface, thereby providing a display of near real-time status or past usage data gathered with regard to operation of one or more of the automatic dispensers.

Figure 30:
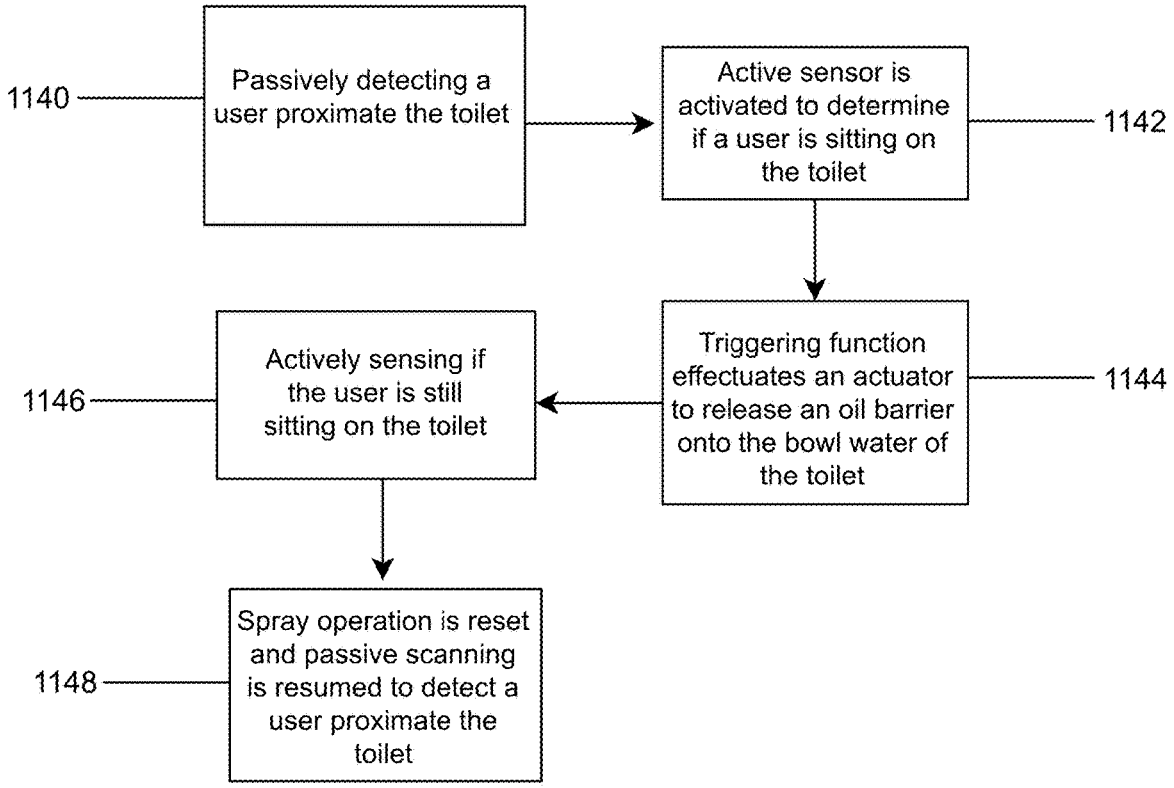
FIG. 30 is a flow diagram for the method of illuminating and treating a toilet bowl.

With continued reference to the drawings, FIG. 30 shows a method for automatically creating an oil barrier on bowl water of a toilet prior to a dispensing of human waste into the toilet. Accordingly, step 1140 comprises passively detecting a user proximate to the toilet. Then, as set forth in step 1142, upon detecting a user proximate to the toilet, an active sensor is activated to determine if a user is sitting on the toilet. Moreover, as set forth in step 1144, upon the user sitting on the toilet, a triggering function effectuates an actuator to release an oil barrier substantially onto the bowl water of the toilet. Next, step 1146 involves actively sensing if the user is still sitting on the toilet. In step 1148, upon detecting that the user is no longer sitting on the toilet, a spray operation is reset, and passive scanning is resumed to detect a user proximate to the toilet. Activation of a scanning function may include activation of one of the active sensor or a passive sensor. In at least one embodiment, an area proximate a toilet is an area within the range of detection of an infrared sensor. In at least one embodiment, a discharge of treatment material may precede a user flushing the toilet. Furthermore, in at least one embodiment, a discharge of treatment material may occur a set period of time after the toilet is flushed.

While this disclosure has been described in conjunction with the specific embodiments outlined above, it is evident that many alternatives, modifications and variations will be apparent to those skilled in the art. For example, a proximity sensor, such as an exterior sensor 20 or 1020, may be mounted on the toilet or on the toilet plumbing. Moreover, the proximity sensor may be, or otherwise tie-in to the functionality of a typical proximity sensor operable with a common automatic flushing toilet, where the flushing is activated by the sensor. In addition, it may be possible to house some, or all of the componentry associated with an automatic toilet water treatment dispenser, within an appropriately modified toilet seat (perhaps including the lid). Such a modified toilet seat (and perhaps the lid) may include sensors and dispensers positioned on the seat (and perhaps the lid) to facilitate sensing, dispensing, and other operations in a manner similar to that disclosed with respect to embodiments of an applicator for automatically dispensing a water surface sealant treatment onto a surface of toilet bowl water, as described herein above. It also may be possible to externally control treatment material dispensing via mechanisms located external to a dispensing apparatus, such that an externally controlled release of treatment material is merely sent through a conduit connected to the applicator device and appropriately discharged through the orifice. The orifice may comprise a rubber stop valve to prevent unwanted leakage. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A method for automatically treating a surface of toilet bowl water with an oil-based liquid barrier, the method comprising:

providing a dispensing apparatus removably mounted to a toilet bowl;

detecting, by a first sensor on the dispensing apparatus, that a user is in an area adjacent to a toilet;

activating, by at least one control circuit, a second sensor on the dispensing apparatus in response to a signal from the first sensor;

detecting, by the second sensor, a user sitting on the toilet; and discharging a volume of the oil-based liquid barrier onto the surface of the toilet bowl water when a user is detected sitting on the toilet.

2. The method of claim 1, further comprising:

sensing, by the second sensor, when the user has stood up from the toilet; and resetting a user scanning protocol for the second sensor.

3. The method of claim 1, wherein the dispensing apparatus comprises a dispensing tip that is positioned away from side walls of the toilet bowl such that the oil-based liquid barrier is prevented from spraying against the side walls of the toilet bowl.

4. The method of claim 1, wherein the second sensor is an infrared sensor.

5. The method of claim 1, wherein the at least one control circuit signals the dispensing apparatus to discharge a volume of the oil-based liquid barrier onto the surface of the toilet bowl water immediately after the second sensor detects the user sitting on the toilet.

6. The method of claim 1, wherein the volume of the oil-based liquid barrier is sized to completely cover a surface area of the toilet bowl water with the oil-based liquid barrier.

7. The method of claim 1, wherein the oil-based liquid barrier is an essential oil.

8. The method of claim 1, further comprising illuminating a light associated with the dispensing apparatus.

9. A method for automatically treating a surface of toilet bowl water with a non-polar solvent, the method comprising:

providing a dispensing apparatus having at least one control circuit in electrical communication with a first and a second sensor and an actuator, wherein the dispensing apparatus is configured to be mounted to a toilet;

loading a cartridge into the dispensing apparatus, the cartridge having a reservoir of the non-polar solvent, a valve, and a power source;

powering the at least one control circuit by the power source;

detecting, by the first sensor, that a user is in an area adjacent to a toilet;

activating, by the at least one control circuit, the second sensor in response to a signal from the first sensor; detecting, by the second sensor, a presence of a user sitting on the toilet;

signaling, by the at least one control circuit, the actuator to open the valve once a second sensor detects to presence of the user; and dispensing a layer of the non-polar solvent onto the surface of the toilet bowl water of the toilet.

10. The method of claim 9, wherein the non-polar solvent coats substantially an entire surface of the toilet bowl water of the toilet.

11. The method of claim 9, wherein the non-polar solvent is an essential oil.

12. The method of claim 9, wherein the second sensor is oriented toward an inside of the toilet.

13. The method of claim 12, wherein the second sensor is an active sensor.

14. The method of claim 9, wherein dispensing a layer of non-polar solvent onto the surface of the toilet bowl water is timed to precede the user flushing the toilet.

15. The method of claim 9, further comprising indicating when the cartridge is empty.

16. The method of claim 9, further comprising detecting when the user is no longer sitting on the toilet.

17. The method of claim 16, further comprising activating a scanning function of one of the second sensor.

18. A method for automatically treating a surface of toilet bowl water with an oil-based treatment, the method comprising:

providing a dispensing apparatus having at least one control circuit in electrical communication with a sensor and an actuator, wherein the dispensing apparatus is configured to be mounted to a toilet;

loading a cartridge into the dispensing apparatus, the cartridge having a reservoir of the oil-based treatment and a power source irremovably coupled to the reservoir, wherein the cartridge is positioned within a body of the dispensing apparatus via an opening in a distal end of the body, and wherein walls of the body completely bound the cartridge when the cartridge is secured within the body;

activating the sensor as a result of a movement by a user;

signaling, by the at least one control circuit, the actuator to open a valve; and dispensing a layer of the oil-based treatment onto the surface of the toilet bowl water of the toilet, wherein a dispensing tip is positioned to dispense the oil-based treatment from the cartridge directly on the surface of the toilet bowl water and is further positioned away from side walls of a toilet bowl, such that the dispensing tip is prevented from spraying the oil-based treatment against the side walls of the toilet bowl.

19. The method of claim 18, wherein the movement by a user comprises a waving of a hand.

20. The method of claim 18, wherein the movement by a user comprises sitting on the toilet.

* * * * *